US008831231B2

(12) United States Patent
Fukui et al.

(10) Patent No.: US 8,831,231 B2
(45) Date of Patent: Sep. 9, 2014

(54) AUDIO SIGNAL PROCESSING DEVICE AND AUDIO SIGNAL PROCESSING METHOD

(75) Inventors: Takao Fukui, Tokyo (JP); Ayataka Nishio, Kanagawa (JP)

(73) Assignee: Sony Corporation, Tokyo (JP)

( * ) Notice: Subject to any disclaimer, the term of this patent is extended or adjusted under 35 U.S.C. 154(b) by 206 days.

(21) Appl. No.: 13/104,614

(22) Filed: May 10, 2011

(65) Prior Publication Data

US 2011/0286601 A1 Nov. 24, 2011

(30) Foreign Application Priority Data

May 20, 2010 (JP) ..... 2010-116150

(51) Int. Cl.
*H04R 5/00* (2006.01)

(52) U.S. Cl.
USPC ..... 381/17; 381/1; 381/18

(58) Field of Classification Search
USPC ..... 381/1, 17, 18, 300, 303, 304, 306, 26, 381/309, 310, 74, 56, 58
See application file for complete search history.

(56) References Cited

U.S. PATENT DOCUMENTS

| | | | | |
|---|---|---|---|---|
| 4,731,848 | A | 3/1988 | Kendall et al. | |
| 5,181,248 | A | 1/1993 | Inanaga et al. | |
| 5,440,639 | A * | 8/1995 | Suzuki et al. | 381/17 |
| 5,717,767 | A | 2/1998 | Inanaga et al. | |
| 5,844,816 | A | 12/1998 | Inanaga et al. | |
| 6,243,476 | B1 | 6/2001 | Gardner | |
| 6,501,843 | B2 | 12/2002 | Usui et al. | |
| 6,738,479 | B1 | 5/2004 | Sibbald et al. | |
| 6,801,627 | B1 | 10/2004 | Kobayashi | |
| 8,503,682 | B2 | 8/2013 | Fukui et al. | |
| 8,520,857 | B2 | 8/2013 | Fukui et al. | |

(Continued)

FOREIGN PATENT DOCUMENTS

| | | |
|---|---|---|
| EP | 1 545 154 A2 | 6/2005 |
| EP | 2096882 A2 | 9/2009 |

(Continued)

OTHER PUBLICATIONS

Speyer et al., A Model Based Approach for Normalizing the Head Related Transfer Function. IEEE. 1996; 125-28.

(Continued)

*Primary Examiner* — Vivian Chin
*Assistant Examiner* — Friedrich W Fahnert
(74) *Attorney, Agent, or Firm* — Wolf, Greenfield & Sacks, P.C.

(57) ABSTRACT

An audio signal processing device includes a processing unit for convoluting head-related transfer functions with audio signals of a plurality of channels, and the processing unit includes a storage unit for storing data of a double-normalized head-related transfer function by normalizing a normalized head-related transfer function obtained by normalizing a head-related transfer function in a state in which a dummy head or a person is present in a position of the listener with a transfer characteristic in a pristine state in which the dummy head or the person is not present, using a normalized head-related transfer function obtained by normalizing a head-related transfer function in the state in which the dummy head or the person is present with a transfer characteristic in the pristine state, and a convolution unit for reading the data from the storage unit and convoluting the data with the audio signals.

14 Claims, 20 Drawing Sheets

(A) HEAD-RELATED TRANSFER FUNCTION MEASUREMENT POSITIONS (B) PRISTINE STATE TRANSFER FUNCTION MEASUREMENT POSITIONS

(56) References Cited

U.S. PATENT DOCUMENTS

| | | | | |
|---|---|---|---|---|
| 2004/0136538 | A1 | 7/2004 | Cohen et al. | |
| 2005/0047619 | A1 | 3/2005 | Murata et al. | |
| 2005/0135643 | A1* | 6/2005 | Lee et al. | 381/309 |
| 2006/0045294 | A1 | 3/2006 | Smyth | |
| 2006/0115091 | A1* | 6/2006 | Kim et al. | 381/18 |
| 2007/0160217 | A1 | 7/2007 | Chun | |
| 2008/0273708 | A1 | 11/2008 | Sandgren et al. | |
| 2009/0010440 | A1 | 1/2009 | Jung et al. | |
| 2009/0028345 | A1 | 1/2009 | Jung et al. | |
| 2009/0043591 | A1 | 2/2009 | Breebaart et al. | |
| 2009/0060205 | A1 | 3/2009 | Jung et al. | |
| 2009/0208022 | A1 | 8/2009 | Fukui et al. | |
| 2009/0214045 | A1* | 8/2009 | Fukui et al. | 381/17 |
| 2010/0322428 | A1 | 12/2010 | Fukui et al. | |
| 2011/0128821 | A1 | 6/2011 | Choi et al. | |
| 2011/0135098 | A1 | 6/2011 | Kuhr et al. | |
| 2011/0176684 | A1 | 7/2011 | Katayama | |
| 2011/0305358 | A1 | 12/2011 | Nishio et al. | |
| 2013/0287235 | A1 | 10/2013 | Fukui et al. | |

FOREIGN PATENT DOCUMENTS

| | | | |
|---|---|---|---|
| JP | 61-245698 | A | 10/1986 |
| JP | 03-214897 | | 9/1991 |
| JP | 5-260590 | A | 10/1993 |
| JP | 6-147968 | A | 5/1994 |
| JP | 06-165299 | A | 6/1994 |
| JP | 06-181600 | A | 6/1994 |
| JP | 07-288899 | A | 10/1995 |
| JP | 07-312800 | A | 11/1995 |
| JP | 8-047078 | A | 2/1996 |
| JP | 8-182100 | A | 7/1996 |
| JP | 09-037397 | A | 2/1997 |
| JP | 09-135499 | A | 5/1997 |
| JP | 09-187100 | A | 7/1997 |
| JP | 09-200898 | A | 7/1997 |
| JP | 09-284899 | A | 10/1997 |
| JP | 10-042399 | A | 2/1998 |
| JP | 11-313398 | | 11/1999 |
| JP | 2000-036998 | A | 2/2000 |
| JP | 2001-285998 | A | 10/2001 |
| JP | 2002-191099 | A | 7/2002 |
| JP | 2002-209300 | A | 7/2002 |
| JP | 2003-061196 | A | 2/2003 |
| JP | 2003-061200 | A | 2/2003 |
| JP | 2004-080668 | A | 3/2004 |
| JP | 2005-157278 | A | 6/2005 |
| JP | 2006-352728 | A | 12/2006 |
| JP | 2007-202021 | A | 8/2007 |
| JP | 2007-240605 | A | 9/2007 |
| JP | 2007-329631 | A | 12/2007 |
| JP | 2008-311718 | A | 12/2008 |
| WO | WO 95/13690 | A1 | 5/1995 |
| WO | WO 95/23493 | A1 | 8/1995 |
| WO | WO 01/31973 | A1 | 5/2001 |

OTHER PUBLICATIONS

Kendall et al. A Spatial Sound Processor for Loudspeaker and Headphone Reproduction. Journal of the Audio Engineering Society, May 30, 1990, vol. 8 No. 27, pp. 209-221, New York, NY.

Extended European Search Report issued Dec. 17, 2013 in connection with European Application No. 10166006.6.

* cited by examiner (A) ITU7.1ch (B) THX7.1ch

DOTTED LINE: HTRF H(REF) OF TV SPEAKER POSITION
SOLID LINE: HTRF H(F) OF 30° POSITION AT RIGHT FROM SCREEN CENTER

NORMALIZED CHARACTERISTIC OF H(F)/H(REF)

AUDIO SIGNAL PROCESSING DEVICE AND AUDIO SIGNAL PROCESSING METHOD

BACKGROUND OF THE INVENTION

1. Field of the Invention

The present invention relates to an audio signal processing device and an audio signal processing method. The present invention relates to an audio signal processing device and an audio signal processing method that perform audio signal processing for enabling audio signals of 2 or more channels such as a multi-channel surround scheme to be acoustically reproduced, for example, by electrical acoustic reproduction means for two channels arranged in a television device. More particularly, the present invention relates to an invention for allowing sound to be listened to as if sound sources were present in previously supposed positions, such as front positions of a listener, when audio signals are acoustically reproduced by electro-acoustic transducing means, such as left and right speakers arranged in a television device.

2. Description of the Related Art

For example, a technique called virtual sound localization is disclosed in Patent Literature 1 (WO95/13690) or Patent Literature 2 (Japanese Patent Laid-open Publication No. 03-214897).

Since the virtual sound localization allows sound to be reproduced as if sound sources, such as speakers, were present in previously supposed positions, such as left and right positions of the front of a listener (a sound image to be virtually localized in the positions) when the sound is reproduced, for example, by left and right speakers arranged in a television device, the virtual sound localization is realized as follows.

FIG. 20 is a diagram illustrating a virtual sound localization technique in a case in which a left and right 2-channel stereo signal is reproduced, for example, by left and right speakers arranged in a television device.

For example, microphones ML and MR are installed in positions near both ears of a listener (measurement point positions), as shown in FIG. 20. Further, speakers SPL and SPR are arranged in positions where virtual sound localization is desired. Here, the speaker is one example of an electro-acoustic transducing unit and the microphone is one example of an acoustic-electric conversion unit.

In a state in which a dummy head 1 (or a person, i.e., a listener) is present, an impulse is first acoustically reproduced by the speaker SPL of one channel, e.g., a left channel. The impulse generated by the acoustic reproduction is picked up by the respective microphones ML and MR to measure a head-related transfer function for the left channel. In the case of this example, the head-related transfer function is measured as an impulse response.

In this case, the impulse response as the head-related transfer function for the left channel includes an impulse response HLd of a sound wave from the left channel speaker SPL picked up by the microphone ML (hereinafter, an impulse response of a left main component), and an impulse response HLc of a sound wave from the left channel speaker SPL picked up by the microphone MR (hereinafter, an impulse response of a left crosstalk component), as shown in FIG. 20.

Next, the impulse is similarly acoustically reproduced by the right channel speaker SPR, and the impulse generated by the reproduction is picked up by the microphones ML and MR. A head-related transfer function for the right channel, i.e., an impulse response for the right channel, is measured.

In this case, the impulse response as the head-related transfer function for the right channel includes an impulse response HRd of a sound wave from the right channel speaker SPR picked up by the microphone MR (hereinafter, referred to as an impulse response of a right main component), and an impulse response HRc of a sound wave from the right channel speaker SPR picked up by the microphone ML (hereinafter, referred to as a an impulse response of a right crosstalk component).

The impulse responses of the head-related transfer functions for the left channel and the right channel obtained by the measurement are directly convoluted with audio signals to be supplied to the left and right speakers arranged in the television device. That is, for the audio signal of the left channel, the impulse response of the left main component and the impulse response of the left crosstalk component, which are the head-related transfer functions for the left channel obtained by the measurement, are directly convoluted. In addition, for the audio signal of the right channel, the impulse response of the right main component and the impulse response of the right crosstalk component, which are the head-related transfer functions for the right channel obtained by the measurement, are directly convoluted.

By doing so, for example, for left and right 2 channel stereo sound, the sound can be localized (virtual sound localization) as if acoustic reproduction were performed by left and right speakers installed in desired positions at the front of the listener despite the acoustic reproduction being performed by the left and right speakers arranged in the television device.

The 2 channels have been described above. However, for multiple channels such as 3 or more channels, similarly, speakers are arranged in virtual sound localization positions of the respective channels to reproduce, for example, an impulse and measure head-related transfer functions for the channels. Impulse responses of the head-related transfer functions obtained by the measurement may be convoluted with audio signals to be supplied to left and right speakers arranged in a television device.

Meanwhile, recently, in acoustic reproduction involved in video reproduction of a digital versatile disc (DVD), a surround scheme for multiple channels, such as 5.1 channels or 7.1 channels, has been used.

Even when an audio signal of the multi surround scheme is acoustically reproduced by left and right speakers arranged in a television device, sound localization according to each channel using the above-described virtual sound localization technique (virtual sound localization) has been proposed.

SUMMARY OF THE INVENTION

For example, when left and right speakers arranged in a television device have a flat frequency or phase characteristic, an ideal surround effect can be theoretically produced by the virtual sound localization technique as described above.

However, in fact, since the left and right speakers arranged in the television device do not have the flat characteristic, expected surround sense is not obtained when an audio signal produced using the virtual sound localization technique as described above is reproduced by the left and right speakers arranged in the television device and the reproduced sound is listened to.

Further, in a case in which an audio signal is reproduced by the left and right speakers arranged in the television device or by left and right speakers in a theater rack, usually, the left and right speakers are arranged in positions below a central position of a monitor screen of the television device. Accordingly, a sound image is obtained as if it were acoustically reproduced sound being output from the position below the central position of the monitor screen. Thereby, the sound is listened to as if it were output in a position below a central position of an image displayed on the monitor screen, such that the listener can feel uncomfortable.

Here, the present invention is made in view of the above-mentioned issue, and aims to provide an audio signal processing device and an audio signal processing method which are novel and improved and are capable of producing an ideal surround effect.

According to an embodiment of the present invention, there is provided an audio signal processing device for generating and outputting audio signals of two channels to be acoustically reproduced by two electro-acoustic transducing units installed toward a listener, from audio signals of a plurality of channels, which are 2 or more channels, the audio signal processing device including a head-related transfer function convolution processing unit for convoluting head-related transfer functions for allowing a sound image to be localized in virtual sound localization positions supposed for the respective channels of the plurality of channels, which are 2 or more channels, and to be listened to when acoustical reproduction is performed by the two electro-acoustic transducing units, with audio signals of the respective channels of the plurality of channels, a 2-channel signal generation unit for generating audio signals of two channels to be supplied to the two electro-acoustic transducing units from the audio signals of the plurality of channels from the head-related transfer function convolution processing unit, wherein the head-related transfer function convolution processing unit comprises a storage unit for storing data of a double-normalized head-related transfer function, the double-normalized head-related transfer function being obtained, for each of the plurality of channels, by normalizing a normalized head-related transfer function in the supposed sound source position using a normalized head-related transfer function in the speaker installation position, wherein the normalized head-related transfer function in the supposed sound source position is obtained by normalizing a head-related transfer function measured from only sound waves directly reaching acoustic-electric conversion means installed in positions near both ears of the listener by picking up sound waves generated in supposed sound source positions using the acoustic-electric conversion means in a state in which a dummy head or a person is present in a position of the listener, with a pristine state transfer characteristic measured from only sound waves directly reaching the acoustic-electric conversion means by picking up the sound waves generated in the supposed sound source position using the acoustic-electric conversion means in a pristine state in which the dummy head or the person is not present, using a normalized head-related transfer function obtained by normalizing a head-related transfer function measured from only sound waves directly reaching acoustic-electric conversion means installed in the positions near both ears of the listener by picking up sound waves separately generated by the two electro-acoustic transducing units using the acoustic-electric conversion means in the state in which the dummy head or the person is present in the position of the listener, with a pristine state transfer characteristic measured from only sound waves directly reaching the acoustic-electric conversion means by picking up the sound waves separately generated by the two electro-acoustic transducing units using the acoustic-electric conversion means in the pristine state in which the dummy head or the person is not present, and a convolution unit for reading the data of the double-normalized head-related transfer function from the storage unit and convoluting the data with the audio signals.

The audio signal processing device may further include a crosstalk cancellation processing unit for performing a process of canceling crosstalk components of the audio signals of two channels of the left and right channels, on the audio signals of the left and right channels among the audio signals of the plurality of channels from the head-related transfer function convolution processing unit, wherein the 2-channel signal generation unit performs generation of audio signals of two channels to be supplied to the two electro-acoustic transducing units, from the audio signals of a plurality of channels from the crosstalk cancellation processing unit.

The crosstalk cancellation processing unit may further performs a process of canceling crosstalk components of the audio signals of the two channels of the left and right channels that have been subjected to the cancellation process, on the audio signals of the left and right channels that have been subjected to the cancellation process.

According to an embodiment of the present invention, there is provided an audio signal processing method in an audio signal processing device for generating and outputting audio signals of two channels to be acoustically reproduced by two electro-acoustic transducing units installed toward a listener, from audio signals of a plurality of channels, which are 2 or more channels, the audio signal processing method include a head-related transfer function convolution process of convoluting, by a head-related transfer function convolution processing unit, head-related transfer functions for allowing a sound image to be localized in virtual sound localization positions supposed for the respective channels of the plurality of channels, which are 2 or more channels, and to be listened to when acoustical reproduction is performed by the two electro-acoustic transducing units, with audio signals of the respective channels of the plurality of channels, and a 2-channel signal generation process of generating, by a 2-channel signal generation unit, audio signals of two channels to be supplied to the two electro-acoustic transducing units, from the audio signals of the plurality of channels as a result of processing in the head-related transfer function convolution process, wherein the head-related transfer function convolution process includes a convolution process of reading data of a double-normalized head-related transfer function from a storage unit and convoluting the data with the audio signals, the storage unit having the data of the double-normalized head-related transfer function stored thereon, and the double-normalized head-related transfer function is obtained, for each of the plurality of channels, by normalizing a normalized head-related transfer function obtained by normalizing a head-related transfer function measured from only sound waves directly reaching acoustic-electric conversion means installed in positions near both ears of the listener by picking up sound waves generated in supposed sound source positions using the acoustic-electric conversion means in a state in which a dummy head or a person is present in a position of the listener, with a pristine state transfer characteristic measured from only sound waves directly reaching the acoustic-electric conversion means by picking up the sound waves generated in the supposed sound source position using the acoustic-electric conversion means in a pristine state in which the dummy head or the person is not present, using a normalized head-related transfer function obtained by normalizing a head-related transfer function measured from only sound waves directly reaching acoustic-electric conversion means installed in the positions near both ears of the listener by picking up sound waves separately generated by the two electro-acoustic transducing units using the acoustic-electric conversion means in the state in which the dummy head or the person is present in the position of the listener, with a pristine state transfer characteristic measured from only sound waves directly reaching the acoustic-electric conversion means by picking up the sound waves separately generated by the two electro-acoustic transducing units using the acoustic-electric conversion means in the pristine state in which the dummy head or the person is not present.

According to an embodiment of the present invention as described above, it is possible to produce an ideal surround effect.

DETAILED DESCRIPTION OF THE EMBODIMENT(S)

Figure 1:
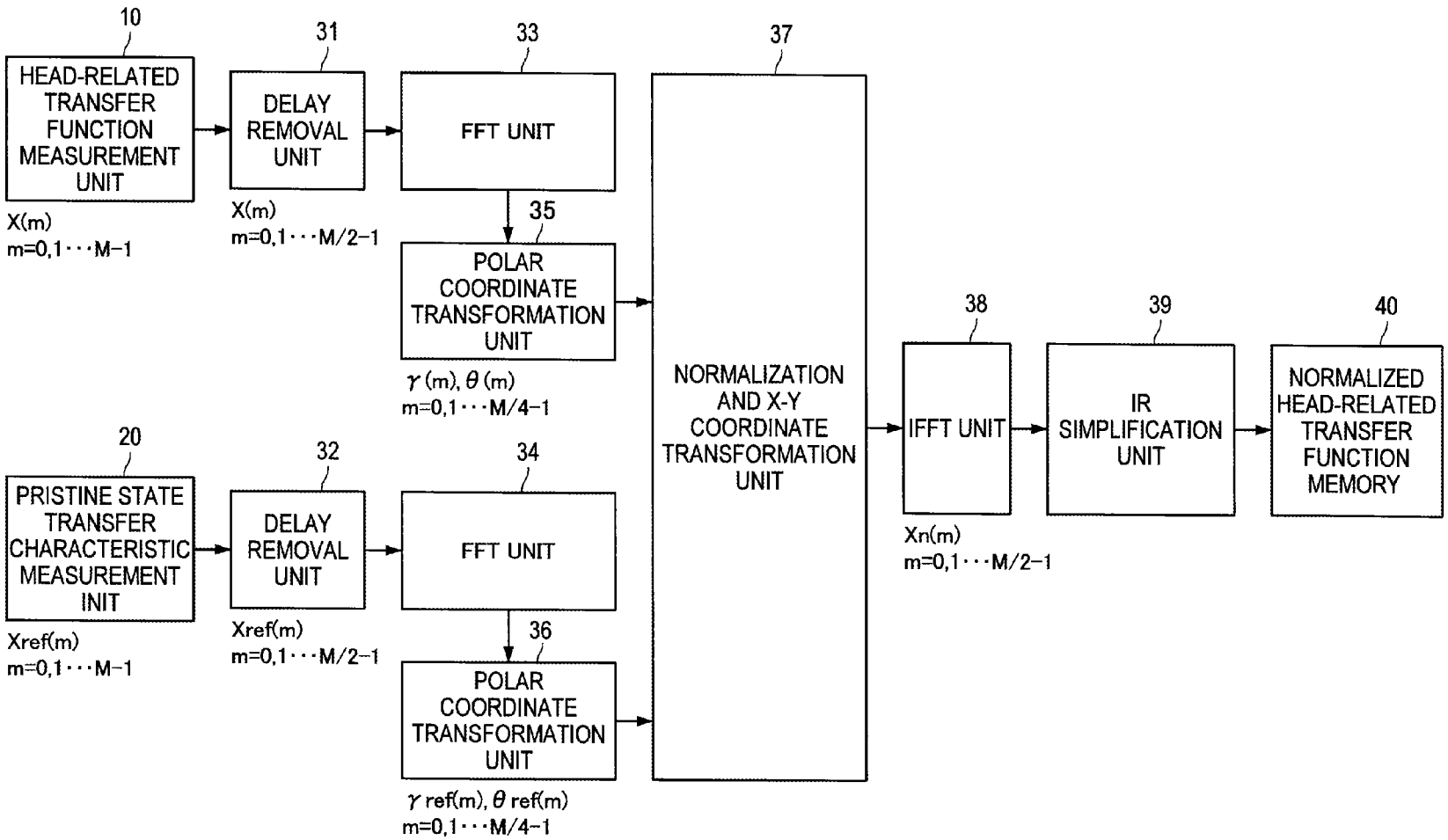
FIG. 1 is a block diagram showing an example of a system configuration to illustrate a device for calculating a head-related transfer function used in an embodiment of an audio signal processing device according to an embodiment of the present invention.

Hereinafter, preferred embodiments of the present invention will be described in detail with reference to the appended drawings. Note that, in this specification and the appended drawings, structural elements that have substantially the same function and structure are denoted with the same reference numerals, and repeated explanation of these structural elements is omitted.

Also, a description will be given in the following order.

1. Head-Related Transfer Function used in Embodiment
2. Overview of Method of Convoluting Head-Related Transfer Function of Embodiment
3. Elimination of Effects of Characteristics of Speakers or Microphones: First Normalization
4. Verification of Effects of Use of Normalized Head-Related Transfer Functions
5. Example of Acoustic Reproduction System using Audio Signal Processing Method of Embodiment; FIGS. 7 to 15

[1. Head-Related Transfer Function used in Embodiment]

First, a method of generating and acquiring a head-related transfer function used in an embodiment of the present invention will be described.

Figure 20:
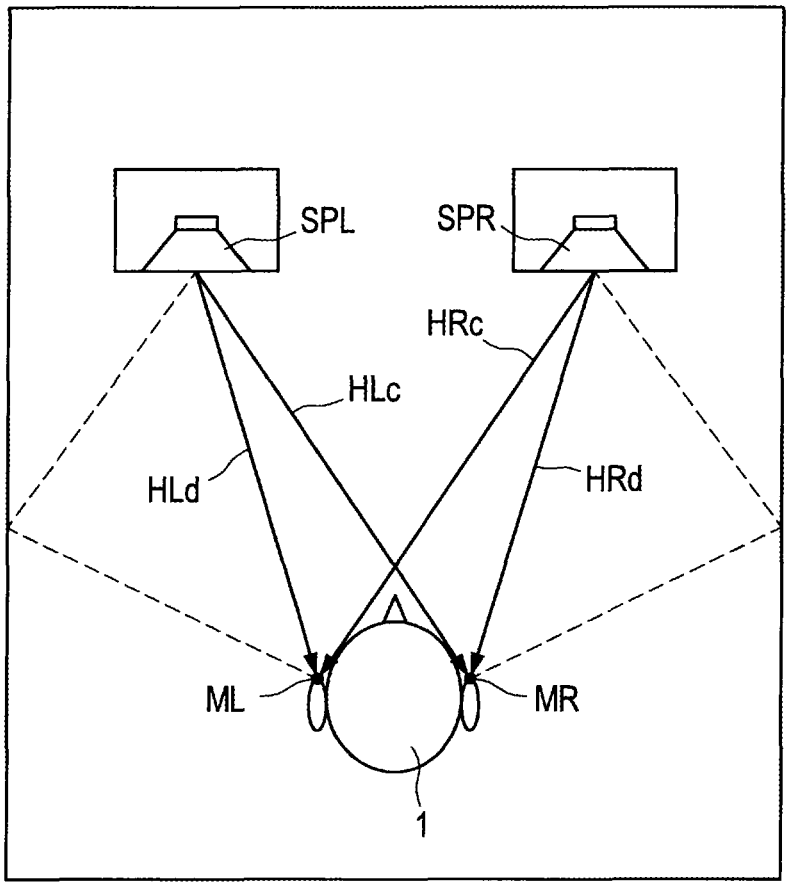
FIG. 20 is a diagram used to illustrate a head-related transfer function.

When a place where measurement of a head-related transfer function is performed is not an anechoic chamber without reflection, reflected wave components as indicated by dotted lines in FIG. 20, as well as direct waves from a supposed sound source position (corresponding to a virtual sound localization position) are included in a measured head-related transfer function instead of being separated. Thereby, the measured head-related transfer function in a related art contains characteristics of the measurement place according to a shape of a room or a place where the measurement has been performed and materials of walls, a ceiling, a floor and the like that reflect a sound wave, due to the components by reflected waves.

In order to eliminate the characteristics of the room or the place, measuring the head-related transfer function in the anechoic chamber without reflection of sound waves from the floor, the ceiling, the walls and the like is considered.

However, when the head-related transfer function measured in the anechoic chamber is directly convoluted with an audio signal for virtual sound localization, a virtual sound localization position or directivity blurs because of absence of reflected waves.

Thereby, in a related art, measurement of the head-related transfer function directly convoluted with an audio signal is not performed in the anechoic chamber, but in a room or a place whose characteristic is excellent despite some effects of the characteristic. For example, a method of suggesting a menu for a room or a place where a head-related transfer function is measured, such as a studio, a hall, and a large room, and receiving a selection of a head-related transfer function of a favorite room or place from among the menu from a user has been proposed.

However, in a related art, a head-related transfer function necessarily involving reflected waves as well as direct waves from sound sources in supposed sound source positions, i.e., a head-related transfer function including impulse responses of the direct waves and the reflected waves, instead of being separated, is obtained through measurement as described above. Thereby, only the head-related transfer function according to the place or the room in which the measurement is performed is obtained. It is difficult to obtain a head-related transfer function according to a desired ambient environment or room environment and convolute the head-related transfer function with an audio signal.

For example, it is difficult to convolute a head-related transfer function according to a listening environment supposed for speakers to be arranged at the front in plains without ambient walls or obstacles, with the audio signal.

Further, when a head-related transfer function is to be obtained in a room having walls with a given supposed shape or capacity and a given absorptance (corresponding to a damping rate of a sound wave), in a related art, such a room needs to be searched for or produced and a head-related transfer function needs to be measured and obtained in the room. However, in fact, it is difficult to search for or produce such a desired listening environment or room, and to convolute a head-related transfer function according to any desired listening or room environment with an audio signal.

In an embodiment described below, in light of the foregoing, a head-related transfer function according to any desired listening or room environment, which is a head-related transfer function for desired virtual sound localization sense, is convoluted with an audio signal.

[2. Overview of Method of Convoluting Head-Related Transfer Function of Embodiment]

As described above, in a method of convoluting a head-related transfer function according to a related art, speakers are installed in sound source positions supposed for virtual sound localization, and head-related transfer functions including impulse responses of direct waves and reflected waves, instead of being separated, are measured. The head-related transfer function obtained by the measurement is directly convoluted with an audio signal.

That is, in a related art, an overall head-related transfer function including the head-related transfer function for the direct wave and the head-related transfer function for the reflected wave from the sound source positions supposed for virtual sound localization is measured instead of being separated and measured.

On the other hand, in an embodiment of the present invention, the head-related transfer function for the direct wave and the head-related transfer function for the reflected wave from the sound source positions supposed for virtual sound localization are separated and measured.

Thereby, in the present embodiment, the head-related transfer function for the direct wave from supposed sound source direction positions supposed in a specific direction, when viewed form a measurement point position (i.e., sound waves directly reaching the measurement point position without the reflected wave) is obtained.

The head-related transfer function for the reflected wave is measured for a direct wave from a sound source direction which is a direction of a sound wave reflected, for example, from a wall. That is, this is because, when a reflected wave reflected from a given wall and then incident to the measurement point position is considered, the reflected sound wave from the wall, which has been reflected from the wall, can be considered a direct wave of a sound wave from a sound source supposed in a reflection position direction from the wall.

In the present embodiment, when a head-related transfer function for direct waves from a supposed sound source positions where virtual sound localization is desired is measured, electro-acoustic transducers, e.g., speakers as means for generating a sound wave for measurement, are arranged in sound source positions supposed for the virtual sound localization. In addition, when a head-related transfer function for reflected waves from the sound source positions supposed for virtual sound localization is measured, electro-acoustic transducers, e.g., speakers as the means for generating a sound wave for measurement, are arranged in a direction in which the reflected wave to be measured is incident to the measurement point position.

Therefore, a head-related transfer function for reflected waves from various directions is measured with electro-acoustic transducers, as means for generating a sound wave for measurement, installed in directions of the respective reflected waves being incident to the measurement point position.

In the present embodiment, the head-related transfer functions for the direct wave and the reflected waves measured as above are convoluted with the audio signal so that virtual sound localization in a target reproduction acoustic space is obtained. However, in this case, the head-related transfer function for only reflected waves in a direction selected according to the target reproduction acoustic space is convoluted with the audio signal.

In the present embodiment, the head-related transfer functions for the direct wave and the reflected waves are measured, with waves suffering from propagation delay according to a length of a sound wave path from the sound source positions for measurement to the measurement point position being removed. When the respective head-related transfer functions are convoluted with the audio signal, the waves suffering from propagation delay according to the length of the sound wave path from the sound source positions for measurement (virtual sound localization positions) to the measurement point position (acoustic reproduction means position for reproduction) are considered.

Accordingly, a head-related transfer function for the virtual sound localization position arbitrarily set, for example, according to a size of the room can be convoluted with the audio signal.

A characteristic such as reflectance or absorptance, for example, due to a material of walls related to a damping rate of the reflected sound wave is supposed as a gain of the direct wave from the walls. That is, in the present embodiment, for example, a head-related transfer function by direct waves from the supposed sound source direction positions to the measurement point position, without attenuation, is convoluted with the audio signal. In addition, for reflected sound wave components from the walls, a head-related transfer function by the direct wave from the supposed sound sources in a reflection position direction of the wall is convoluted by a damping rate (gain) according to reflectance or absorptance according to the characteristic of the wall.

When the reproduced sound for the audio signal with which the head-related transfer functions have been convoluted is listened to, a state of the virtual sound localization can be verified by reflectance or absorptance according to the characteristic of the wall.

Further, the head-related transfer function for the direct wave and the head-related transfer function for the selected reflected wave are convoluted with the audio signal while considering a damping rate for acoustical reproduction, such that virtual sound localization in various room and place environments can be simulated. This can be realized by separating the direct wave and the reflected wave from the supposed sound source direction positions and measuring the head-related transfer functions.

[3. Elimination of Effects of Characteristics of Speakers or Microphones: First Normalization]

As described above, the head-related transfer function for only direct waves, and not reflected wave components, from specific sound sources can be obtained, for example, through measurement in the anechoic chamber. Here, head-related transfer functions for direct waves from desired virtual sound localization positions and a plurality of supposed reflected waves are measured in the anechoic chamber and used for convolution.

That is, microphones as acoustic-electric conversion units receiving a sound wave for measurement are installed in measurement point positions near both ears of a listener in the anechoic chamber. In addition, sound sources that generate a sound wave for measurement are installed in positions in directions of the direct waves and the plurality of reflected waves, and measurement of the head-related transfer function is performed.

Meanwhile, even when the head-related transfer function has been obtained in the anechoic chamber, it is difficult to exclude characteristics of speakers and microphones of a measurement system that measures the head-related transfer function. Thereby, the head-related transfer function obtained by the measurement is affected by the characteristics of the speakers or the microphones used for the measurement.

In order to eliminate the effects of characteristics of the microphones or the speakers, use of expensive microphones and speakers having a flat frequency characteristic and an excellent characteristic as microphones and speakers used for the measurement of the head-related transfer function is considered.

However, an ideal flat frequency characteristic is not obtained even with expensive microphones or speakers and the effects of characteristics of the microphones or the speakers are not completely eliminated, such that sound quality of reproduced sound may be degraded.

Correcting an audio signal with which the head-related transfer function has been convoluted using inverse characteristics of microphones or speakers of the measurement system to eliminate the effects of characteristics of the microphones or speakers is also considered. However, in this case, a correction circuit needs to be provided in an audio signal reproduction circuit, making a configuration complex, and it is difficult to perform correction completely eliminating the effects of the measurement system.

In view of the above problems, a normalization process to be described below is performed on the head-related transfer function obtained by the measurement in order to eliminate the effects of the room or the place for measurement and, in the present embodiment, in order to eliminate the effects of the characteristic of the microphones or speakers used for measurement. First, an embodiment of a method of measuring a head-related transfer function in the present embodiment will be described with reference to the accompanying drawings.

FIG. 1 is a block diagram showing an example of a configuration of a system for executing a processing procedure for acquiring data of a normalized head-related transfer function, which is used in a method of measuring a head-related transfer function in an embodiment of the present invention.

A head-related transfer function measurement unit 10 performs, in this example, measurement of the head-related transfer function in an anechoic chamber in order to measure a head-related transfer characteristic of only direct waves. For the head-related transfer function measurement unit 10, in the anechoic chamber, a dummy head or a person is arranged as a listener in a listener position, as in FIG. 20 described above. Two microphones are installed as acoustic-electric conversion units for receiving a sound wave for measurement near both ears of the dummy head or the person (in a measurement point position).

A speaker, which is one example of a sound source for generating a sound wave for measurement, is installed in a direction in which the head-related transfer function is to be measured from a microphone position that is a listener or measurement point position. In this state, a sound wave for measurement of the head-related transfer function, such as an impulse in this example, is reproduced by the speaker and an impulse response is picked up by the two microphones. Hereinafter, a position in which the speaker is installed as a sound source for measurement and in a direction in which the head-related transfer function is desired to be measured is referred to as a supposed sound source direction position.

In the head-related transfer function measurement unit 10, impulse responses obtained from the two microphones represent head-related transfer functions.

A pristine state transfer characteristic measurement unit 20 performs measurement of a transfer characteristic of a pristine state in which the dummy head or the person is not present in the listener position, that is, an obstacle is not present between the position of the sound source for measurement and the measurement point position, in the same environment as for the head-related transfer function measurement unit 10.

That is, for the pristine state transfer characteristic measurement unit 20, the pristine state in which an obstacle is not present between the speaker and the microphones in the supposed sound source direction positions is prepared, with the dummy head or the person installed for the head-related transfer function measurement unit 10 removed from the anechoic chamber.

An arrangement of the speakers or the microphones in the supposed sound source direction position is completely the same as that for the head-related transfer function measurement unit 10. In this state, the sound wave for measurement, such as an impulse in this example, is reproduced by the speaker in the supposed sound source direction position. The two microphones pick up the reproduced impulse.

In the pristine state transfer characteristic measurement unit 20, impulse responses obtained from outputs of the two microphones represent a transfer characteristic in the pristine state in which the obstacle such as the dummy head or the person is not present.

Also, in the head-related transfer function measurement unit 10 and the pristine state transfer characteristic measurement unit 20, for the direct waves, a head-related transfer function and a pristine state transfer characteristic for the left and right main components described above, and a head-related transfer function and a pristine state transfer characteristic for left and right crosstalk components are obtained from the respective two microphones. A normalization process, which will be described below, is similarly performed on the main components and the left and right crosstalk components.

Hereinafter, for simplification of a description, for example, the normalization process for only the main components will be described and a description of the normalization process for the crosstalk components will be omitted.

Needless to say, the normalization process is similarly performed on the crosstalk component.

The impulse responses acquired by the head-related transfer function measurement unit 10 and the pristine state transfer characteristic measurement unit 20 are output, in this example, as digital data of 8192 samples having a sampling frequency of 96 kHz.

Here, data of the head-related transfer function obtained from the head-related transfer function measurement unit 10 is denoted by X(m), where m=0, 1, 2, . . . , M−1 (M=8192). Further, data of the pristine state transfer characteristic obtained from the pristine state transfer characteristic measurement unit 20 is denoted by Xref(m), where m=0, 1, 2, . . . , M−1 (M=8192).

The data X(m) of the head-related transfer function from the head-related transfer function measurement unit 10 and the data Xref(m) of the pristine state transfer characteristic from the pristine state transfer characteristic measurement unit 20 is supplied to delay removal units 31 and 32.

In the delay removal units 31 and 32, data of a head portion from a time when the impulse begins to be reproduced by the speaker is removed by data for a delay time corresponding to a time for the sound wave from the speaker in the supposed sound source direction position to reach the microphone for impulse response acquisition. In the delay removal units 31 and 32, further, a data number is reduced to a power of 2 data number for an orthogonal transformation process from time axis data to frequency axis data in a next stage (next process).

Next, the data X(m) of the head-related transfer function and the data Xref(m) of the pristine state transfer characteristic whose data numbers are reduced by the delay removal units 31 and 32 are supplied to fast Fourier transform (FFT) units 33 and 34, respectively. In the FFT units 33 and 34, data is transformed from time axis data into frequency axis data. In addition, in the present embodiment, in the FFT units 33 and 34, a complex FFT process considering a phase is performed.

Through the complex FFT process in the FFT unit 33, the data X(m) of the head-related transfer function is transformed into FFT data including a real part R(m) and an imaginary part jI(m), i.e., R(m)+jI(m).

Further, through the complex FFT process in the FFT unit 34, the data Xref(m) of the pristine state transfer characteristic is transformed into FFT data including a real part Rref(m) and an imaginary part jIref(m), i.e., Rref(m)+jIref(m).

The FFT data obtained by the FFT units 33 and 34 is X-Y coordinate data, but in the present embodiment, the FFT data is further transformed into polar coordinate data by polar coordinate transformation units 35 and 36. That is, the FFT data R(m)+jI(m) of the head-related transfer function is transformed into a size component, moving radius γ(m), and an angular component, deflection angle θ(m), by the polar coordinate transformation unit 35. The polar coordinate data, moving radius γ(m) and deflection angle θ(m), is sent to a normalization and X-Y coordinate transformation unit 37.

Further, the FFT data Rref (m)+jIref (m) of the pristine state transfer characteristic is transformed into moving radius γref(m) and deflection angle θref(m) by the polar coordinate transformation unit 36. The polar coordinate data, moving radius γref(m) and deflection angle θref(m), is sent to the normalization and X-Y coordinate transformation unit 37.

The normalization and X-Y coordinate transformation unit 37 first normalizes the head-related transfer function measured with the dummy head or the person, using the pristine state transfer characteristic in which the obstacle such as the dummy head is not present. Here, a concrete operation in the normalization process is as follows.

That is, when the normalized moving radius is γn(m) and the normalized deflection angle is θn(m), $$\gamma n(m)=\gamma(m)/\gamma\mathrm{ref}(m), \text{ and}$$

$$\theta n(m)=\theta(m)-\theta\mathrm{ref}(m). \quad (1)$$

The normalization and X-Y coordinate transformation unit 37 transforms the normalized polar coordinate system data, moving radius γn(m) and deflection angle θn(m), into frequency axis data including a real part Rn(m) and an imaginary part jIn(m) (m=0, 1 . . . M/4−1) of the X-Y coordinate system. The transformed frequency axis data is normalized head-related transfer function data.

The normalized head-related transfer function data of the frequency axis data of the X-Y coordinate system is transformed into an impulse response Xn(m), which is normalized head-related transfer function data of the time axis by an inverse FFT (IFFT) unit 38. The IFFT unit 38 performs a complex IFFT process.

That is, an operation, $$Xn(m)=\mathrm{IFFT}(Rn(m)+jIn(m))$$

where m=0, 1, 2 . . . , M/2−1 is performed by the IFFT unit 38. Thus, the impulse response Xn(m), which is the normalized head-related transfer function data of the time axis, is obtained from the IFFT unit 38.

The data Xn(m) of the normalized head-related transfer function from the IFFT unit 38 is simplified into a tap length of an impulse characteristic for processing (convoluting which will be described below) by an impulse response (IR) simplification unit 39. In the present embodiment, the data is simplified into 600 taps (600 data from a head of the data from the IFFT unit 38).

Data Xn(m) (m=0, 1, . . . , 599) of the normalized head-related transfer function simplified by the IR simplification unit 39 is written to a normalized head-related transfer function memory 40 for the convolution process, which will be described below. In addition, the normalized head-related transfer function written to the normalized head-related transfer function memory 40 includes the normalized head-related transfer function of the main components and the normalized head-related transfer function of the crosstalk components in the respective supposed sound source direction positions (virtual sound localization positions), as described above.

The process in which the speaker for reproducing the sound wave for measurement (e.g., impulse) is installed in one supposed sound source direction position spaced a given distance from the measurement point position (microphone position) in one specific direction for the listener position, and a normalized head-related transfer function for the speaker installation position is acquired has been described.

In the present embodiment, the supposed sound source direction position, which is an installation position of the speaker for reproducing the impulse as the sound wave for measurement, is variously changed in different directions for the measurement point position, and a normalized head-related transfer function for each supposed sound source direction position is acquired as described above.

That is, in the present embodiment, in order to acquire head-related transfer functions for reflected waves, as well as the direct waves from the virtual sound localization positions, the supposed sound source direction positions are set in a plurality of positions in consideration of directions of the reflected waves being incident to the measurement point position, and the normalized head-related transfer functions are obtained.

Here, the supposed sound source direction position that is the speaker installation position is set by changing an angle range of 360° or 180° around the microphone position or the listener, which is the measurement point position, for example at 10° intervals within a horizontal plane. The setting is performed in consideration of necessary resolution for a direction of a reflected wave to be obtained, in order to obtain normalized head-related transfer functions for reflected waves from walls at the left and right of the listener.

Similarly, the supposed sound source direction position that is the speaker installation position is set by changing the angle range of 360° or 180° around the microphone position or the listener, which is the measurement point position, for example at 10° intervals within a vertical plane. The setting is performed in consideration of necessary resolution for a direction of a reflected wave to be obtained, in order to obtain normalized head-related transfer functions for a reflected wave from a ceiling or a floor.

When the angle range of 360° is considered, it is supposed that the virtual sound localization position for the direct wave is present at the rear of the listener, for example, that surround sound of multiple channels, such as 5.1 channels, 6.1 channels or 7.1 channels, is reproduced. Further, even when a reflected wave from a wall at the rear of the listener is considered, the angle range of 360° needs to be considered.

When the angle range of 180° is considered, it is supposed that the virtual sound localization position as the direct wave is present only at the front of the listener and a reflected wave from a wall at the rear of the listener need not be considered.

Figure 2:
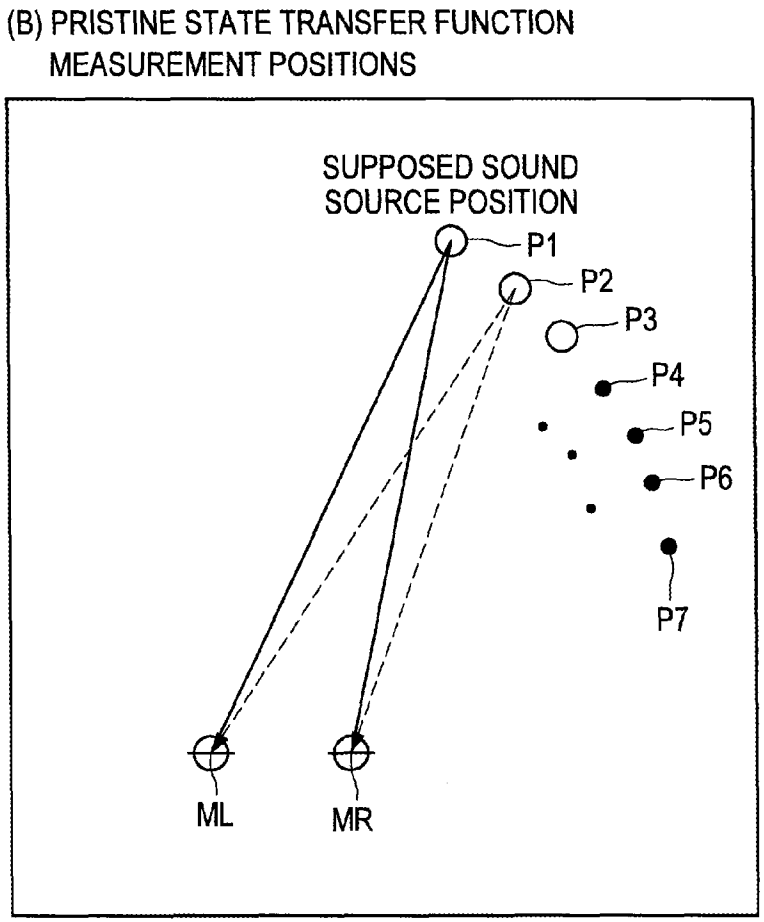
FIG. 2 is a diagram illustrating measurement positions when the head-related transfer function used in the embodiment of the audio signal processing device according to an embodiment of the present invention is calculated.
Figure 2:
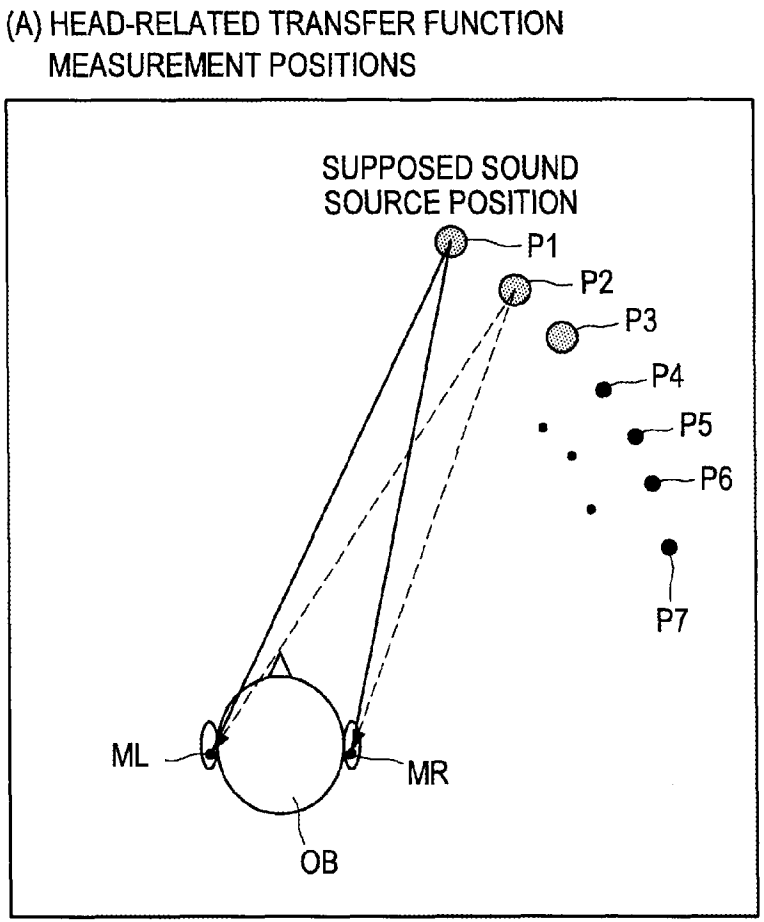

FIG. 2 is a diagram illustrating measurement positions of a head-related transfer function and a pristine state transfer characteristic (supposed sound source direction positions), and microphone installation positions as measurement point positions.

Since FIG. 2(A) shows a measurement state in the head-related transfer function measurement unit 10, a dummy head or a person OB is arranged in a listener position. Speakers for reproducing an impulse in the supposed sound source direction positions are arranged in positions as indicated by circles P1, P2, P3, . . . in FIG. 2(A). That is, in this example, the speakers are arranged in given positions at 10° intervals in a direction in which the head-related transfer function is desired to be measured, around a central position of the listener position.

In this example, two microphones ML and MR are installed in positions within auricles of ears of the dummy head or the person, as shown in FIG. 2(A).

Since FIG. 2(B) shows a measurement state in the pristine state transfer characteristic measurement unit 20, it shows a state of a measurement environment in which the dummy head or the person OB in FIG. 2(A) is removed.

In the above-described normalization process, head-related transfer functions measured in the respective supposed sound source direction positions indicated by the circles P1, P2, . . . , in FIG. 2(A) are normalized with pristine state transfer characteristics measured in the same supposed sound source direction positions P1, P2, . . . , in FIG. 2(B). That is, for example, the head-related transfer function measured in the supposed sound source direction position P1 is normalized with the pristine state transfer characteristic measured in the same supposed sound source direction position P1.

Accordingly, for example, a head-related transfer function for only direct waves, and not the reflected waves, from virtual sound source positions spaced at 10° intervals can be obtained as the normalized head-related transfer function written to the normalized head-related transfer function memory 40.

For the acquired normalized head-related transfer function, the characteristic of the speakers for generating an impulse and the characteristic of the microphones for picking up the impulse are excluded by the normalization process.

Further, for the acquired normalized head-related transfer function, in this example, a delay corresponding to a distance between the position of the speaker for generating the impulse (supposed sound source direction position) and the position of the microphone for picking up the impulse is removed by the delay removal units 31 and 32. Therefore, the acquired normalized head-related transfer function, in this example, is not related to the distance between the position of the speaker for generating the impulse (supposed sound source direction position) and the position of the microphone for picking up the impulse. That is, the acquired normalized head-related transfer function is a head-related transfer function according to only the direction of the position of the speaker for generating the impulse (the supposed sound source direction position), when viewed from the position of the microphone for picking up the impulse.

When the normalized head-related transfer function is convoluted with the audio signal for the direct waves, the delay according to the distance between the virtual sound localization position and the microphone position is assigned to the audio signal. Then, the assigned delay allows the acoustic reproduction to be performed using a distance position according to the delay in the direction of the supposed sound source direction position with respect to the microphone position, as the virtual sound localization position.

For the reflected wave from a direction of the supposed sound source direction position, a direction in which the wave is incident to the microphone position after being reflected by a reflecting portion, such as a wall, from the position where virtual sound localization is desired is considered the direction of the supposed sound source direction position for the reflected wave. A delay according to a length of a sound wave path for the reflected wave from the supposed sound source direction position direction to the wave incident to the microphone position is performed on the audio signal, and the normalized head-related transfer function is convoluted.

That is, for the direct wave and the reflected wave, when the normalized head-related transfer function is convoluted with the audio signal, a delay according to the length of the sound wave path from the position where the virtual sound localization is desired to the wave incident to the microphone position is performed on the audio signal.

Signal processing in the block diagram of FIG. 1 illustrating an embodiment of a method of measuring a head-related transfer function may all be performed by a digital signal processor (DSP). In this case, an acquisition unit of the data X(m) of the head-related transfer function and the data Xref (m) of the pristine state transfer characteristic in the head-related transfer function measurement unit 10 and the pristine state transfer characteristic measurement unit 20, the delay removal units 31 and 32, the FFT units 33 and 34, the polar coordinate transformation units 35 and 36, the normalization and X-Y coordinate transformation unit 37, the IFFT unit 38, and the IR simplification unit 39 may be configured of a DSP, or all signal processing may be performed by one or a plurality of DSPs.

Further, in the example of FIG. 1 described above, for the data of the normalized head-related transfer function or the pristine state transfer characteristic, the delay removal units 31 and 32 remove first data for a delay time corresponding to the distance between the supposed sound source direction position and the microphone position and perform head wrapping. This is intended to reduce a convolution processing amount for the head-related transfer function, which will be described below, but the data removing process in the delay removal units 31 and 32 may be performed, for example, using an internal memory of the DSP. However, when the delay removal process need not be performed, the DSP directly processes original data with data of 8192 samples.

Since the IR simplification unit 39 is intended to reduce a convolution processing amount in a process of convoluting the head-related transfer function, which will be described below, the IR simplification unit 39 may be omitted.

Further, in the above-described embodiment, the frequency axis data of the X-Y coordinate system from the FFT units 33 and 34 is transformed into the frequency data of the polar coordinate system because the normalization process may not be performed with the frequency data of the X-Y coordinate system. However, for an ideal configuration, the normalization process can be performed with the frequency data of the X-Y coordinate system.

In the above-described example, various virtual sound localization positions and directions in which the reflected wave is incident to the microphone positions are supposed to obtain the normalized head-related transfer functions for a number of supposed sound source direction positions. The normalized head-related transfer functions for a number of supposed sound source direction positions are obtained in order to select a necessary head-related transfer function for the supposed sound source direction position direction from the normalized head-related transfer functions.

However, when the virtual sound localization position has been fixed in advance and the incident direction of the reflected wave has been determined, it is understood that a normalized head-related transfer function for the fixed virtual sound localization position or a supposed sound source direction position in the incident direction of the reflected wave can be obtained.

In addition, in the above-described embodiment, the measurement is performed in the anechoic chamber in order to measure head-related transfer functions and the pristine state transfer characteristics for only direct waves from a plurality of supposed sound source direction positions. However, even in a room or a place with reflected waves, rather than the anechoic chamber, only a direct wave component may be extracted with a time window when the reflected waves are greatly delayed from a direct wave.

Further, a sound wave for measurement of the head-related transfer function generated by the speaker in the supposed sound source direction position may be a time stretched pulse (TSP) signal, rather than the impulse. When the TSP signal is used, a head-related transfer function and a pristine state transfer characteristic for only a direct wave can be measured by eliminating reflected waves even in a non-anechoic chamber.

[4. Verification of Effects of Use of Normalized Head-Related Transfer Functions]

Figure 3:
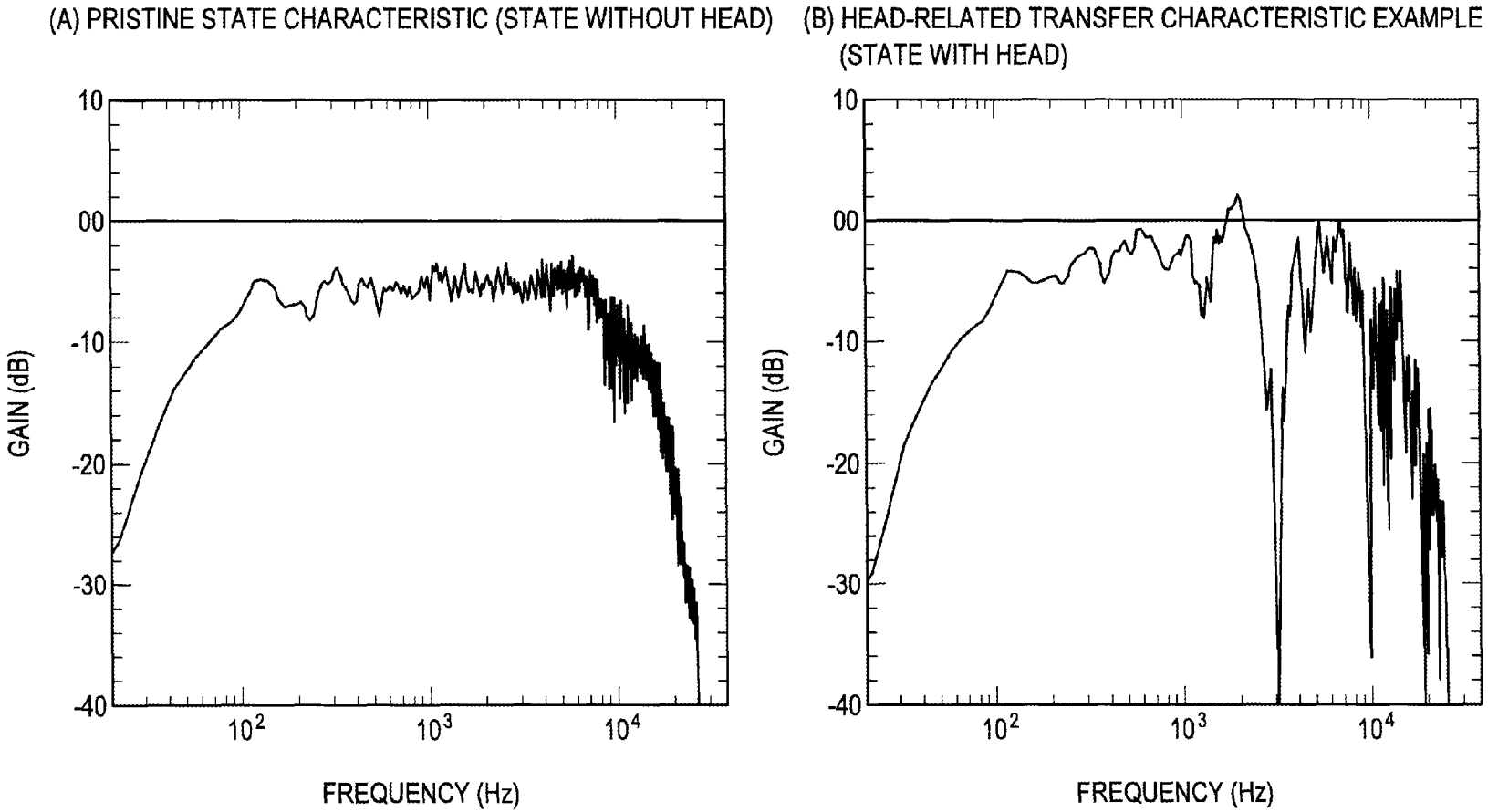
FIG. 3 is an illustrative diagram illustrating examples of characteristics of measurement result data obtained by a head-related transfer function measurement unit and a pristine state transfer characteristic measurement unit in an embodiment of the present invention.

A characteristic of a measurement system including speakers and microphones actually used for measurement of head-related transfer functions is shown in FIG. 3. That is, FIG. 3(A) shows a frequency characteristic of an output signal from a microphone when sound of a frequency signal from 0 to 20 kHz is reproduced at the same certain level by speakers and picked up by the microphones in a state in which an obstacle, such as a dummy head or a person, is not included.

The speaker used herein is a speaker for business having a fairly excellent characteristic. However, the speaker has the characteristic as shown in FIG. 3(A), not a flat frequency characteristic. In fact, the characteristic of FIG. 3(A) is an excellent characteristic belonging to a group of fairly flat characteristics above general speakers.

In a related art, since the characteristic of the system of the speaker and the microphone is added to the head-related transfer functions and is not removed, a characteristic or sound quality of sound that may be obtained by convoluting the head-related transfer functions depends on the characteristic of the system of the speaker and the microphone.

FIG. 3(B) shows a frequency characteristic of an output signal from the microphone in the state in which the obstacle, such as a dummy head or a person, is included, in the same condition. It can be seen that large dips are generated in the vicinity of 1200 Hz or 10 kHz and a fairly fluctuant frequency characteristic is obtained.

Figure 4:
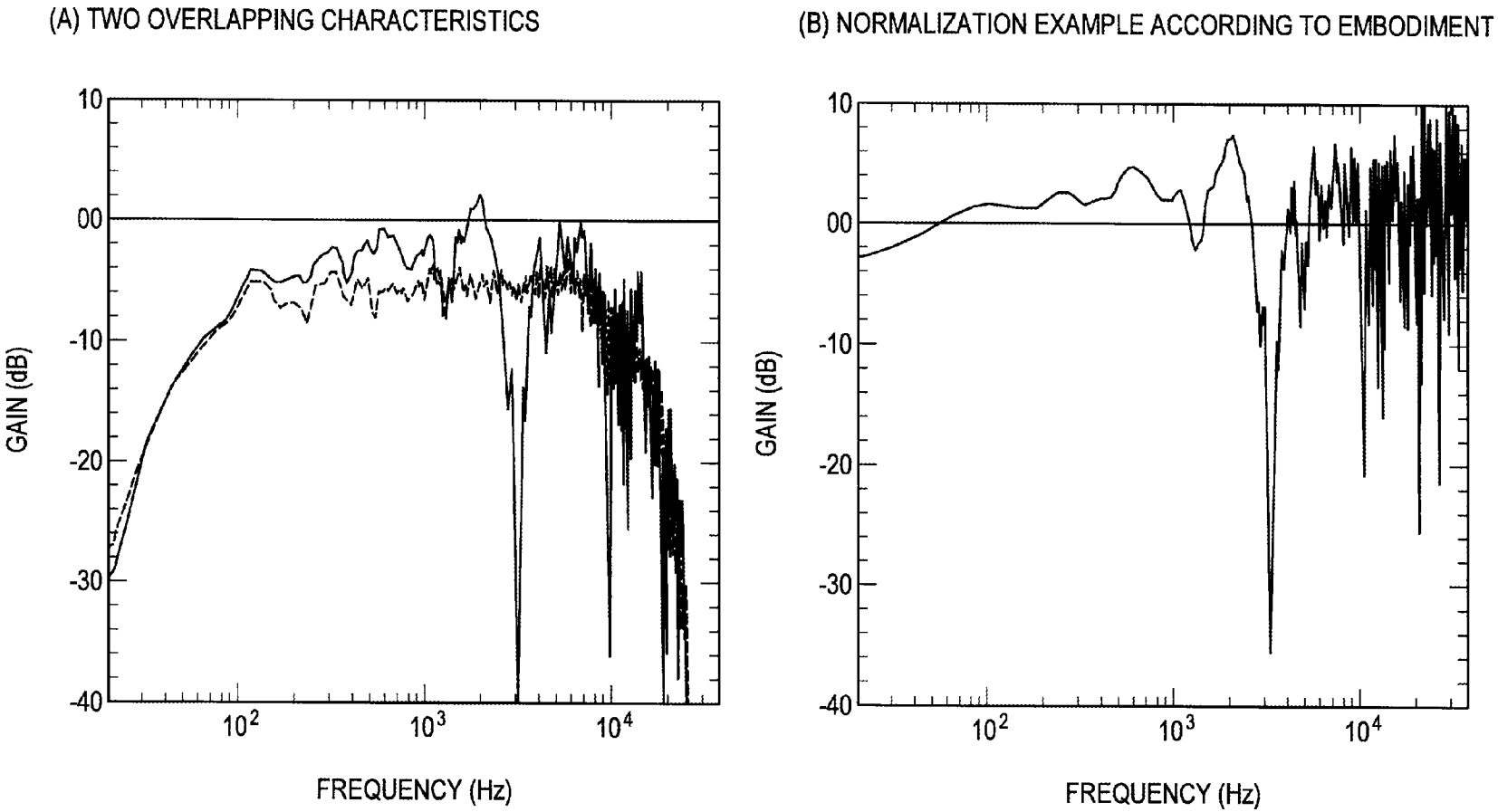
FIG. 4 is a diagram showing examples of characteristics of a normalized head-related transfer function obtained by an embodiment of the present invention.

FIG. 4(A) is a frequency characteristic diagram in which the frequency characteristic of FIG. 3(A) overlaps with the frequency characteristic of FIG. 3(B).

On the other hand, FIG. 4(B) shows a characteristic of the head-related transfer function normalized by the embodiment as described above. It can be seen from FIG. 4(B) that in the characteristic of the normalized head-related transfer function, a gain is not reduced even in a low frequency.

In the above-described embodiment, the complex FFT process is performed and the normalized head-related transfer function considering the phase component is used. Thereby, fidelity of the normalized head-related transfer function is high in comparison with the case in which the head-related transfer functions normalized using only the amplitude component without consideration of the phase are used.

Figure 5:
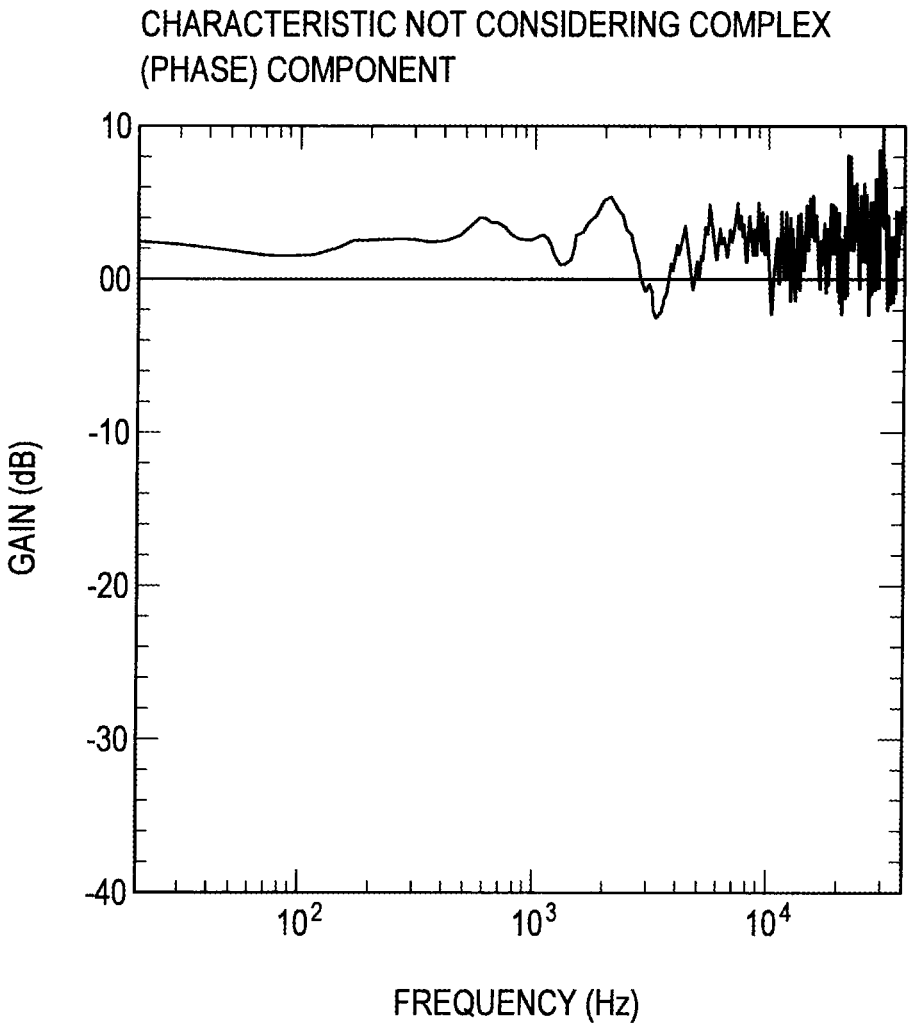
FIG. 5 is a diagram showing an example of a characteristic compared with a characteristic of a normalized head-related transfer function obtained by an embodiment of the present invention.

That is, a characteristic obtained by performing the process of normalizing only the amplitude without consideration of the phase and performing FFT on an ultimately used impulse characteristic again is shown in FIG. 5.

From a comparison between FIG. 5, and FIG. 4(B) showing the characteristic of the normalized head-related transfer function of the present embodiment, the following can be seen. That is, a characteristic difference between the head-related transfer function X(m) and the pristine state transfer characteristic Xref(m) is correctly obtained in the complex FFT of the present embodiment as shown in FIG. 4(B), but deviation from an original one occurs as shown in FIG. 5 when the phase is not considered.

Further, in the processing procedure of FIG. 1 described above, since the simplification of the normalized head-related transfer function is last performed by the IR simplification unit 39, a characteristic difference is small in comparison with the case in which the data number is first reduced for processing.

Figure 6:
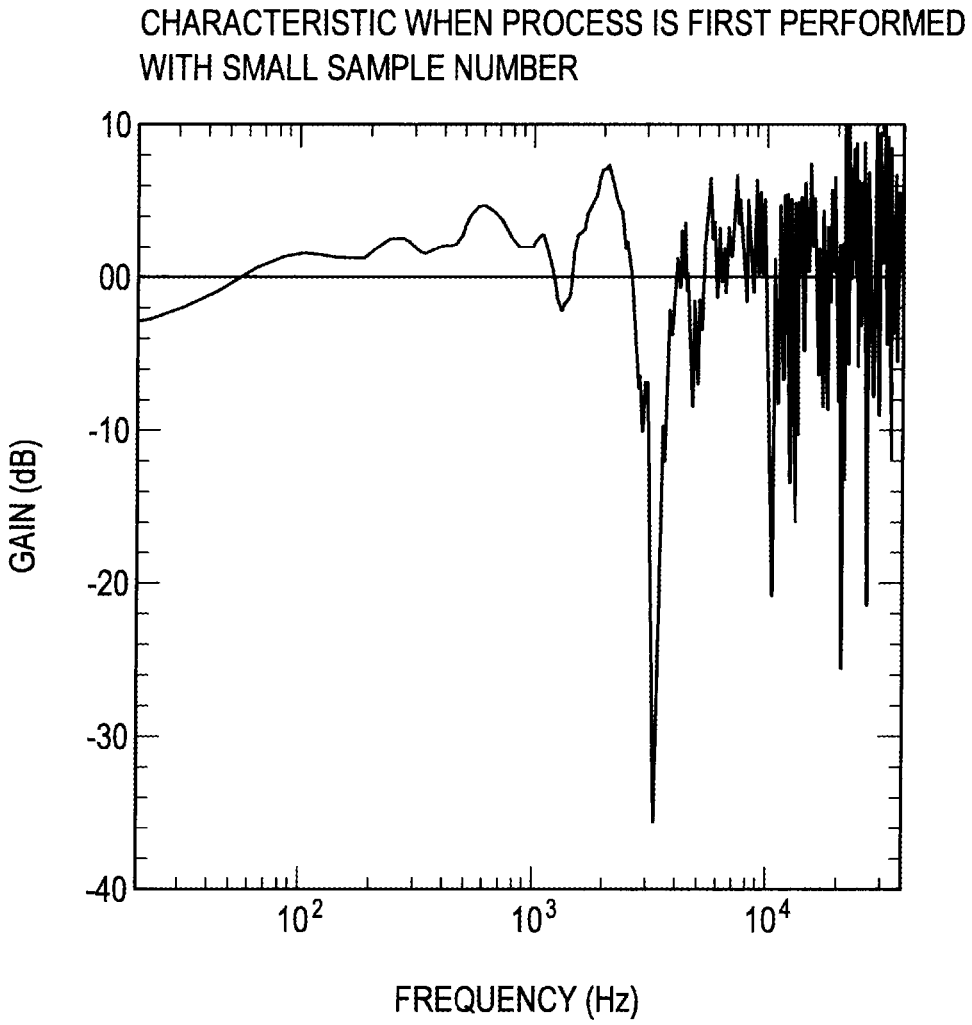
FIG. 6 is a diagram showing an example of a characteristic compared with a characteristic of a normalized head-related transfer function obtained by an embodiment of the present invention.
Figure 7:
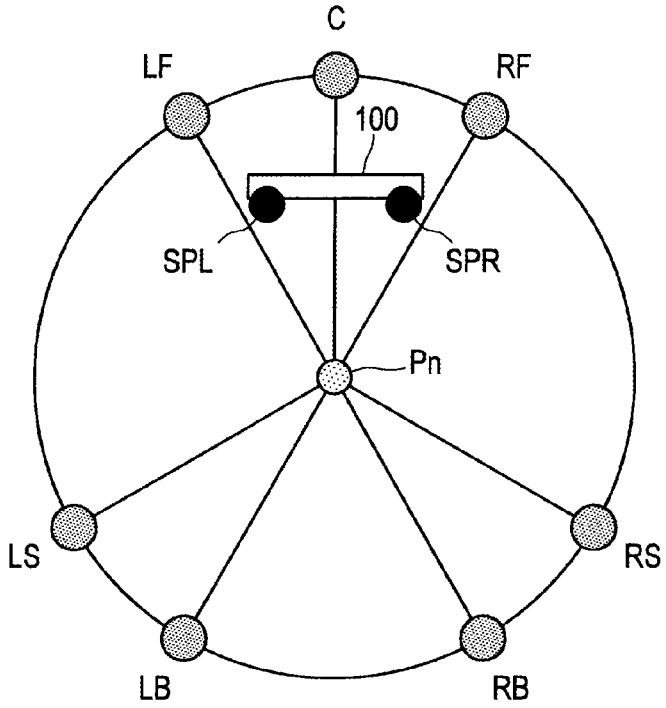
FIG. 7(A) is an illustrative diagram illustrating an example of a speaker arrangement for 7.1 channel multi surround by the International Telecommunication Union (ITU)-R.
FIG. 7(B) is an illustrative diagram illustrating an example of a speaker arrangement for 7.1 channel multi surround recommended by THX, Inc.
Figure 7:
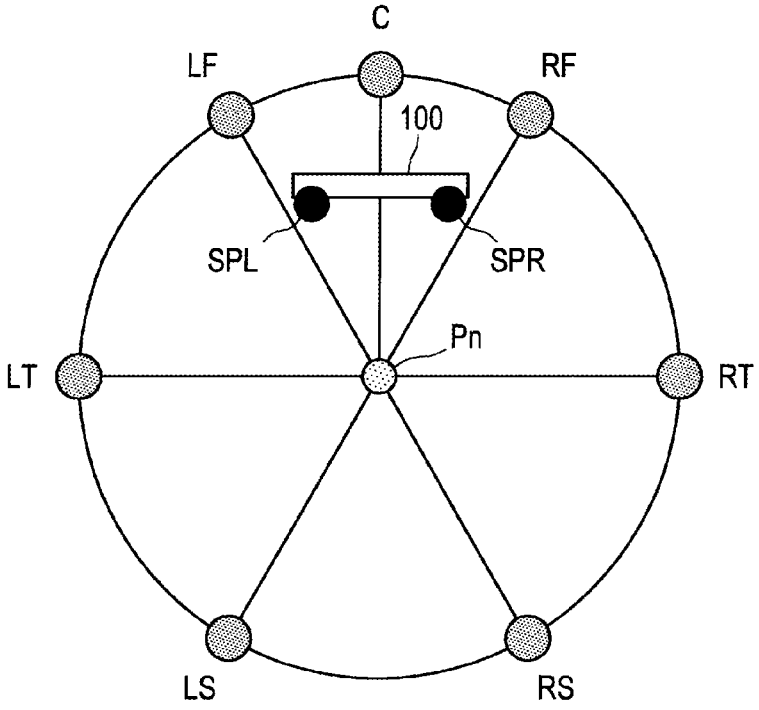
Figure 8:
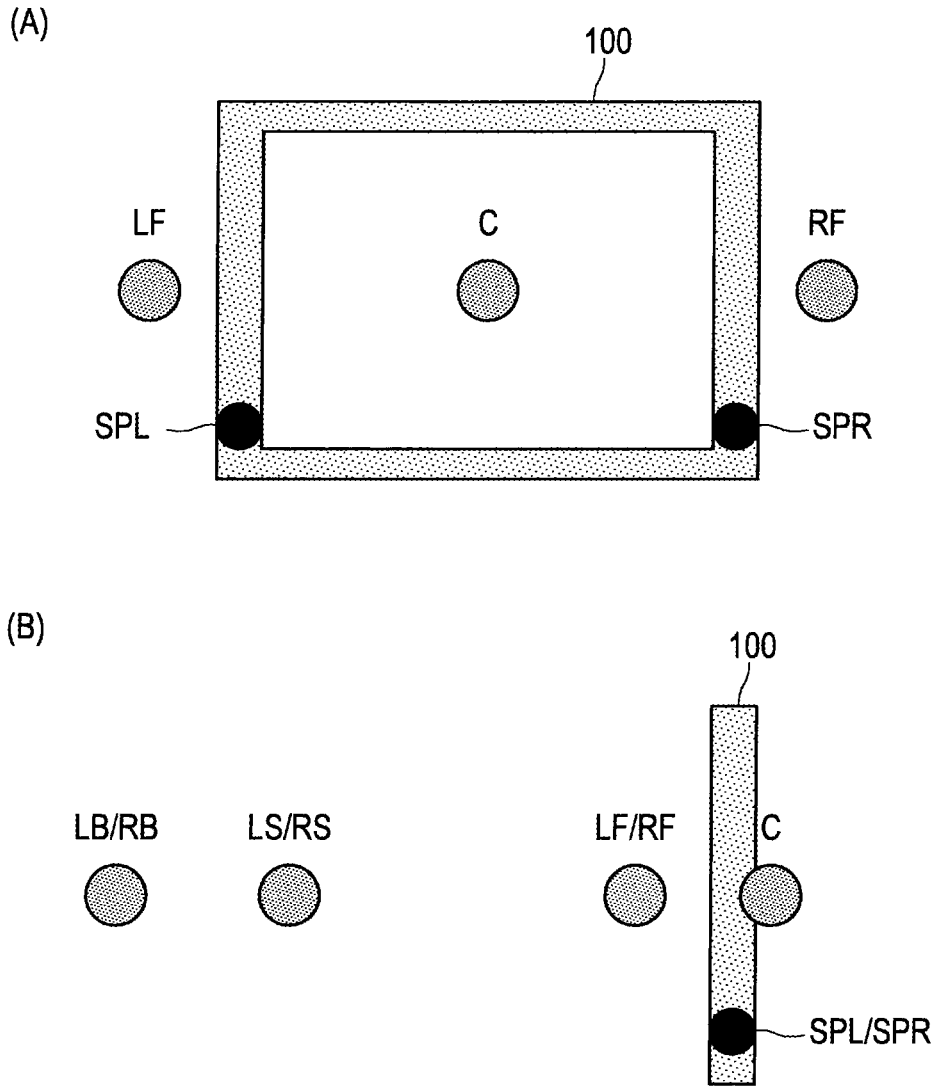
FIG. 8(A) is an illustrative diagram illustrating a case in which a television device direction is viewed from a listener position in an example of a speaker arrangement for 7.1 channel multi surround of ITU-R.
FIG. 8(B) is an illustrative diagram illustrating a case in which the television device direction is viewed from a lateral direction in the example of the speaker arrangement for 7.1 channel multi surround of ITU-R.

That is, when the simplification to reduce the data number is first performed (when the normalization is performed, with impulse numbers less than an ultimately necessary impulse number being zero) on the data obtained by the head-related transfer function measurement unit 10 and the pristine state transfer characteristic measurement unit 20, a characteristic of a normalized head-related transfer function is as shown in FIG. 6, and in particular, a difference in low frequency characteristic is generated. On the other hand, the characteristic of the normalized head-related transfer function obtained by the configuration of the above-described embodiment is as shown in FIG. 4(B), and the difference in characteristic is not generated even in the low frequency.

[5. Example of Acoustic Reproduction System using Audio Signal Processing Method of Embodiment; FIGS. 7 to 15]

Next, a case in which the embodiment of the audio signal processing device according to an embodiment of the present invention is applied, for example, to a case in which a multi surround audio signal is reproduced using left and right speakers arranged in a television device will be described by way of example. That is, in an example described below, the above-described normalized head-related transfer function is convoluted with an audio signal of each channel so that reproduction using virtual sound localization can be performed.

FIG. 7(A) is an illustrative diagram illustrating an example of a speaker arrangement for 7.1 channel multi surround by International Telecommunication Union (ITU)-R, and FIG. 7(B) is an illustrative diagram illustrating an example of a speaker arrangement for 7.1 channel multi surround recommended by THX, Inc.

In an example described below, the speaker arrangement for 7.1 channel multi surround by ITU-R shown in FIG. 7(A) is supposed, and the head-related transfer function is convoluted so that sound components of respective channels are virtual sound localized in speaker arrangement positions for 7.1 channel multi surround by left and right speakers SPL and SPR arranged in a television device 100.

In the example of the speaker arrangement for 7.1 channel multi surround of ITU-R, the speakers of the respective channels are located on a circumference around a center of a listener position Pn, as shown in FIG. 7(A).

In FIG. 7(A), a front position of the listener, C, is a position of a speaker of a center channel. Positions LF and RF spaced by an angle range of 60° at the both sides of the speaker position C of the center channel indicate positions of speakers of a left front channel and a right front channel, respectively.

Two speaker positions LS and LB and two speaker positions RS and RB are set at the left and right in a range between 60° to 150° to the left and right from the front position C of the listener, respectively. The speaker positions LS and LB and the speaker positions RS and RB are set in positions that are vertically symmetrical with respect to the listener. The speaker positions LS and RS are speaker positions of a left channel and a right channel, and the speaker positions LB and RB are speaker positions of a left rear channel and a right rear channel.

FIG. 8(A) is an illustrative diagram illustrating a case in which a direction of the television device 100 is viewed from a listener position in the example of the speaker arrangement for the 7.1 channel multi surround of ITU-R, and FIG. 8(B) is an illustrative diagram illustrating a case in which the television device 100 is viewed from a lateral direction in the example of the speaker arrangement for the 7.1 channel multi surround of ITU-R.

As shown in FIGS. 8(A) and 8(B), usually, the left and right speakers SPL and SPR of the television device 100 are arranged in positions below a central position of a monitor screen (in FIG. 8(A), a center of the speaker position C). Thereby, a sound image is obtained so that acoustically reproduced sound is output from the position below the central position of the monitor screen.

In the present embodiment, when a multi surround audio signal of 7.1 channels is acoustically reproduced by the left and right speakers SPL and SPR in this example, acoustic reproduction is performed, with directions of the respective speaker positions C, LF, RF, LS, RS, LB and RB in FIGS. 7(A), 8(A) and 8(B) being virtual sound localization directions. Thereby, the selected normalized head-related transfer function is convoluted with an audio signal of each channel of the multi surround audio signal of 7.1 channels, as described below.

Figure 9:
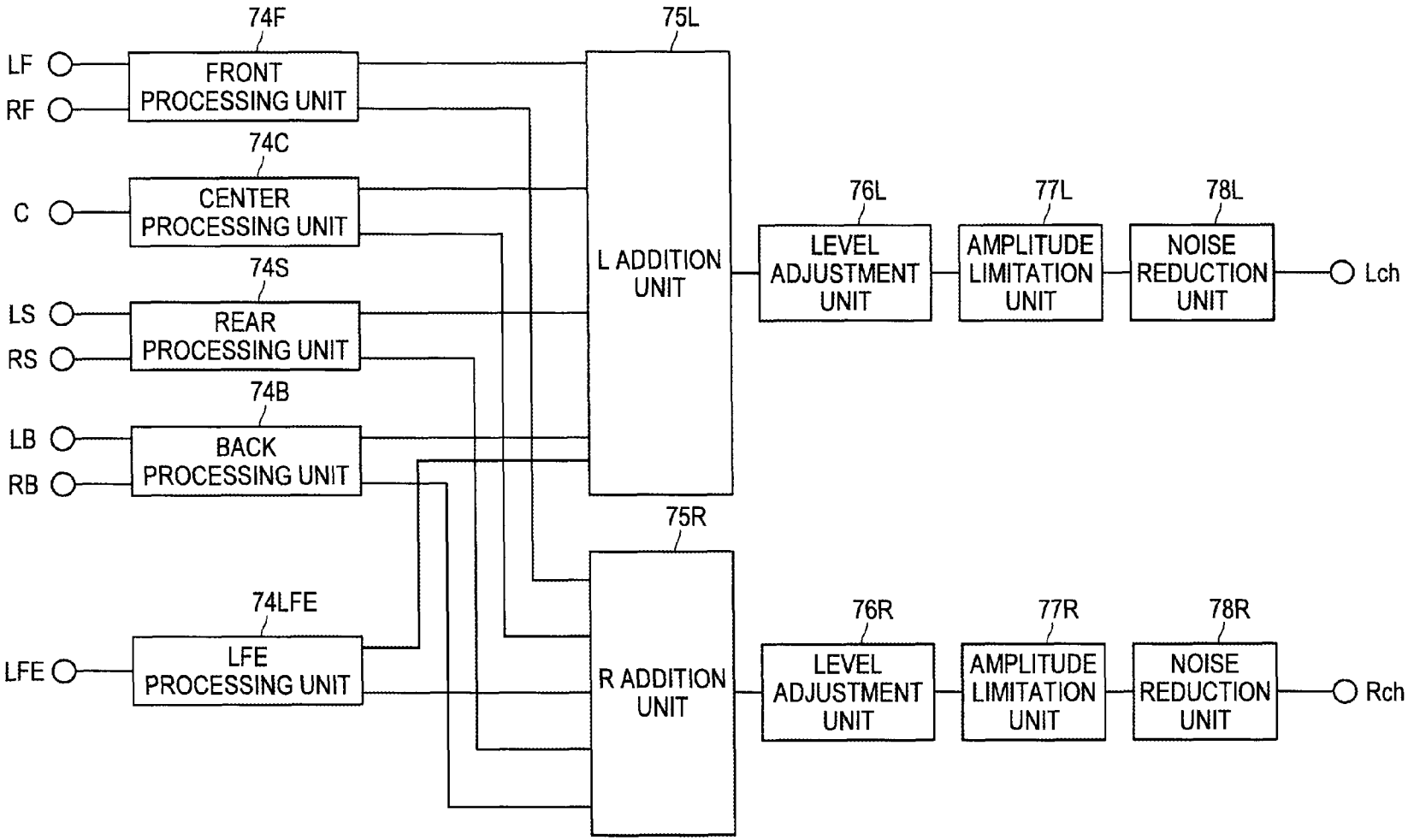
FIG. 9 is an illustrative diagram illustrating an example of a hardware configuration of an acoustic reproduction system using an audio signal processing device of an embodiment of the present invention.

FIG. 9 is an illustrative diagram illustrating an example of a hardware configuration of an acoustic reproduction system using the audio signal processing device of an embodiment of the present invention.

In the example shown in FIG. 9, an electro-acoustic transducing unit includes a left channel speaker SPL and a right channel speaker SPR.

In FIG. 9, audio signals of the respective channels to be supplied to the speaker positions C, LF, RF, LS, RS, LB and RB of FIG. 7(A) are indicated using the same symbols C, LF, RF, LS, RS, LB and RB. Here, in FIG. 9, a low frequency effect (LFE) channel is an LFE channel. This is, usually, sound whose sound localization direction is not determined. In the present embodiment, it is supposed that two LFE channel speakers are arranged at both sides of the speaker position C of the center channel, for example, in positions spaced by an angle range of 15°.

As shown in FIG. 9, audio signals LF and RF of the 7.1 channels are supplied to a front processing unit 74F. Audio signal C of the 7.1 channels is supplied to a center processing unit 74C. Audio signals LS and RS of the 7.1 channels are supplied to a rear processing unit 74S. Audio signals LB and RB of the 7.1 channels are supplied to a back processing unit 74B. An audio signal LFE of the 7.1 channels is supplied to the LFE processing unit 74LFE.

The front processing unit 74F, the center processing unit 74C, the rear processing unit 74S, the back processing unit 74B, and the LFE processing unit 74LFE perform, in this example, a process of convoluting a normalized head-related transfer function of a direct wave, a process of convoluting a normalized head-related transfer function of a crosstalk component of each channel, and a crosstalk cancellation process, respectively, as described below.

In this example, in each of the front processing unit 74F, the center processing unit 74C, the rear processing unit 74S, the back processing unit 74B, and the LFE processing unit 74LFE, the reflected wave is not processed.

Output audio signals from the front processing unit 74F, the center processing unit 74C, the rear processing unit 74S, the back processing unit 74B, and the LFE processing unit 74LFE are supplied to an addition unit for a left channel of 2 channel stereo (hereinafter, referred to as an L addition unit) 75L and an addition unit for a right channel (hereinafter, referred to as an R addition unit) 75R, which constitute an addition processing unit (not shown) as a 2 channel signal generation means.

The L addition unit 75L adds original left channel components LF, LS and LB, crosstalk components of the right channel components RF, RS and RB, a center channel component C, and an LFE channel component LFE.

The L addition unit 75L supplies the result of the addition as a synthesized audio signal for the left channel speaker to a level adjustment unit 76L.

The R addition unit 75R adds the original right channel components RF, RS and RB, crosstalk components of the left channel components LF, LS and LB, a center channel component C, and an LFE channel component LFE.

The R addition unit 75R supplies the result of the addition, as a synthesized audio signal for the right channel speaker, to a level adjustment unit 76R.

In this example, the center channel component C and the LFE channel component LFE are supplied to both the L addition unit 75L and the R addition unit 75R, and added to the left channel and the right channel. Accordingly, more excellent sound localization of sound in the center channel direction can be obtained and a low frequency sound component by the LFE channel component LFE can be reproduced adequately with further expansion.

The level adjustment unit 76L performs level adjustment of the synthesized audio signal for the left channel speaker supplied from the L addition unit 75L. The level adjustment unit 76R performs level adjustment of the synthesized audio signal for the right channel speaker supplied from the R addition unit 75R.

The synthesized audio signals from the level adjustment unit 76L and the level adjustment unit 76R are supplied to amplitude limitation units 77L and 77R, respectively.

The amplitude limitation unit 77L performs amplitude limitation of the level-adjusted synthesized audio signal supplied from the level adjustment unit 76L. The amplitude limitation unit 77R performs amplitude limitation of the level-adjusted synthesized audio signal supplied from the level adjustment unit 76R.

The synthesized audio signals from the amplitude limitation unit 77L and the amplitude limitation unit 77R are supplied to noise reduction units 78L and 78R, respectively.

The noise reduction unit 78L reduces a noise of the amplitude-limited synthesized audio signal supplied from the amplitude limitation unit 77L. The noise reduction unit 78R reduces a noise of the amplitude-limited synthesized audio signal supplied from the amplitude limitation unit 77R.

The output audio signals from the noise reduction units 78L and 78R are supplied to and acoustically reproduced by the left channel speaker SPL and the right channel speaker SPR, respectively.

Meanwhile, for example, when the left and right speakers arranged in the television device have a flat frequency or phase characteristic, the above-described normalized head-related transfer function is convoluted with sound of each channel, such that an ideal surround effect can be theoretically produced.

However, in fact, since the left and right speakers arranged in the television device do not have a flat characteristic, expected surround sense is not obtained when the audio signal produced using the technique described above is reproduced by the left and right speakers arranged in the television device and the reproduced sound is listened to.

Further, when an audio signal is reproduced by the left and right speakers arranged in the television device or by left and right speakers in a theater rack, usually, the left and right speakers are arranged in positions below a central position of a monitor screen of the television device. Accordingly, a sound image is obtained as if acoustically reproduced sound were output from the positions below the central position of the monitor screen. Thereby, the sound is listened to as if the sound were output in positions below a central position of an image displayed on the monitor screen, such that a listener can feel uncomfortable.

In light of the foregoing, in the embodiment of the present invention, examples of internal configurations of the front processing unit 74F, the center processing unit 74C, the rear processing unit 74S, the back processing unit 74B, and the LFE processing unit 74LFE are those as shown in FIGS. 10 to 15.

In the present embodiment, all normalized head-related transfer functions are normalized with the normalized head-related transfer function "Fref" for the direct wave from the positions of the left and right speakers arranged in the television device.

That is, a normalized head-related transfer function of a convolution circuit for each channel in the examples of FIGS. 10 to 15 is obtained by multiplying the normalized head-related transfer function by 1/Fref.

Figure 17:
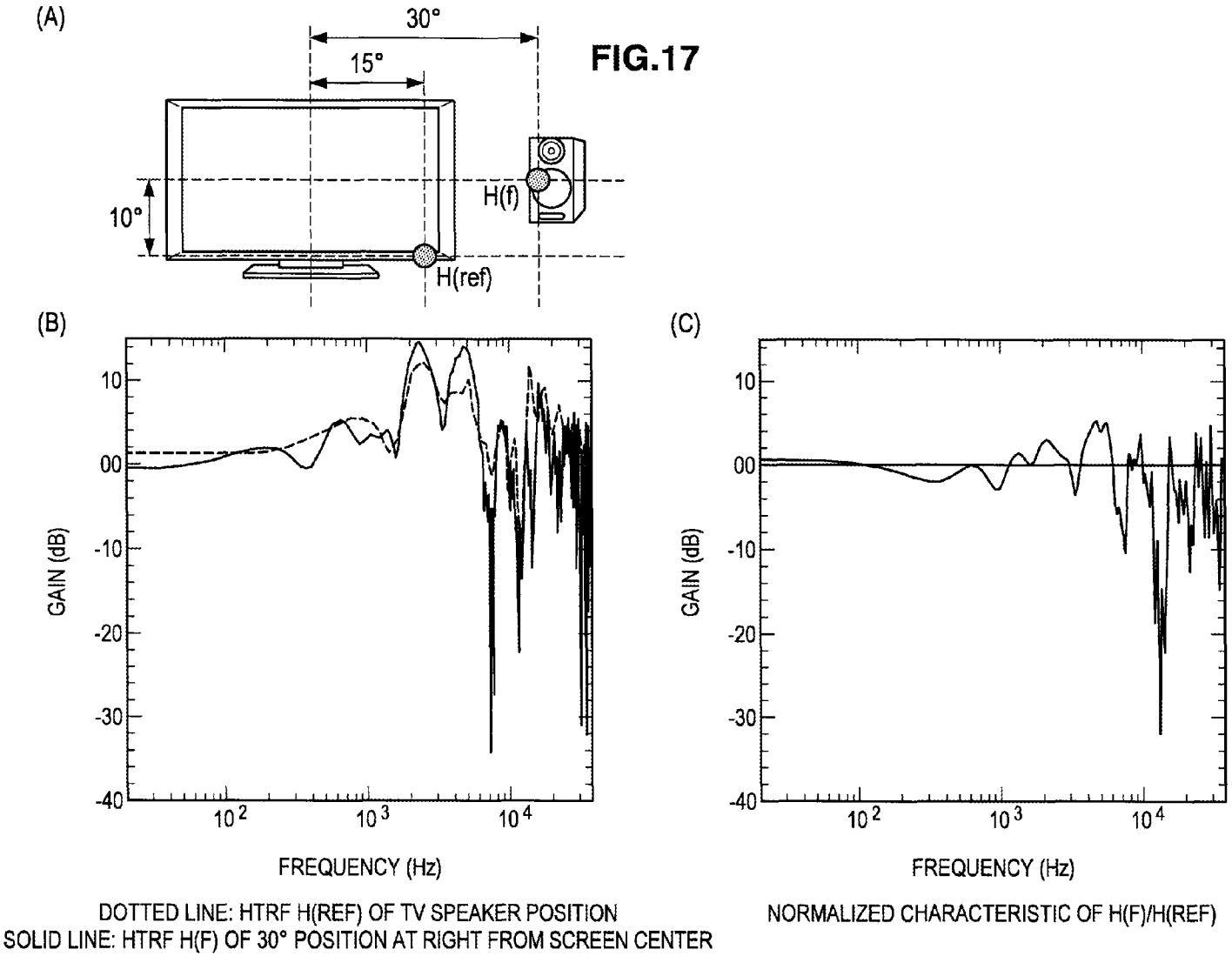
FIG. 17 is a diagram showing an example of a characteristic of a normalized head-related transfer function obtained by an embodiment of the present invention.

For example, as shown in FIG. 17(A), a head-related transfer function (HTRF) of a speaker position of a television device is H(ref), and an HTRF of the speaker position of the virtual sound localization position is H(f). In this case, as shown in FIG. 17(B), a dotted line indicates a characteristic of the HTRF of a speaker position of a television device, H(ref), and a solid line indicates a characteristic of the HTRF of the speaker position of the virtual sound localization position, H(f). A characteristic obtained by normalizing the HTRF of the speaker position of the virtual sound localization position with the HTRF of the speaker position of a television device is as shown in FIG. 17(C).

Here, in this example, since in the left and right channels, a symmetrical relationship with respect to a line connecting the front and the rear of the listener as a symmetrical axis is satisfied, the same normalized head-related transfer function is used.

Here, a notation without distinguishing between the left and right channels is as follows:

direct wave: F, S, B, C, LFE crosstalk over the head: xF, xS, xB, xLFE reflected wave: Fref, Sref, Bref, Cref.

Further, the head-related transfer function subjected to the first normalization process described above in the supposed position of the listener from the supposed positions of the left and right speakers SPL and SPR of the television device 100 is denoted as follows:

direct wave: Fref crosstalk over the head: xFref

Therefore, the normalized head-related transfer functions convoluted by the front processing unit 74F, the center processing unit 74C, the rear processing unit 74S, the back processing unit 74B, and the LFE processing unit 74LFE in the example of FIGS. 10 to 15 are as follows:

That is, direct wave: F/Fref, S/Fref, B/Fref, C/Fref, LFE/Fref crosstalk over the head: xF/Fref, xS/Fref, xB/Fref, xLFE/Fref.

If the notation indicates the normalized head-related transfer function, the normalized head-related transfer functions convoluted by the front processing unit 74F, the center processing unit 74C, the rear processing unit 74S, the back processing unit 74B, and the LFE processing unit 74LFE are those shown in FIGS. 10 to 15.

Figure 10:
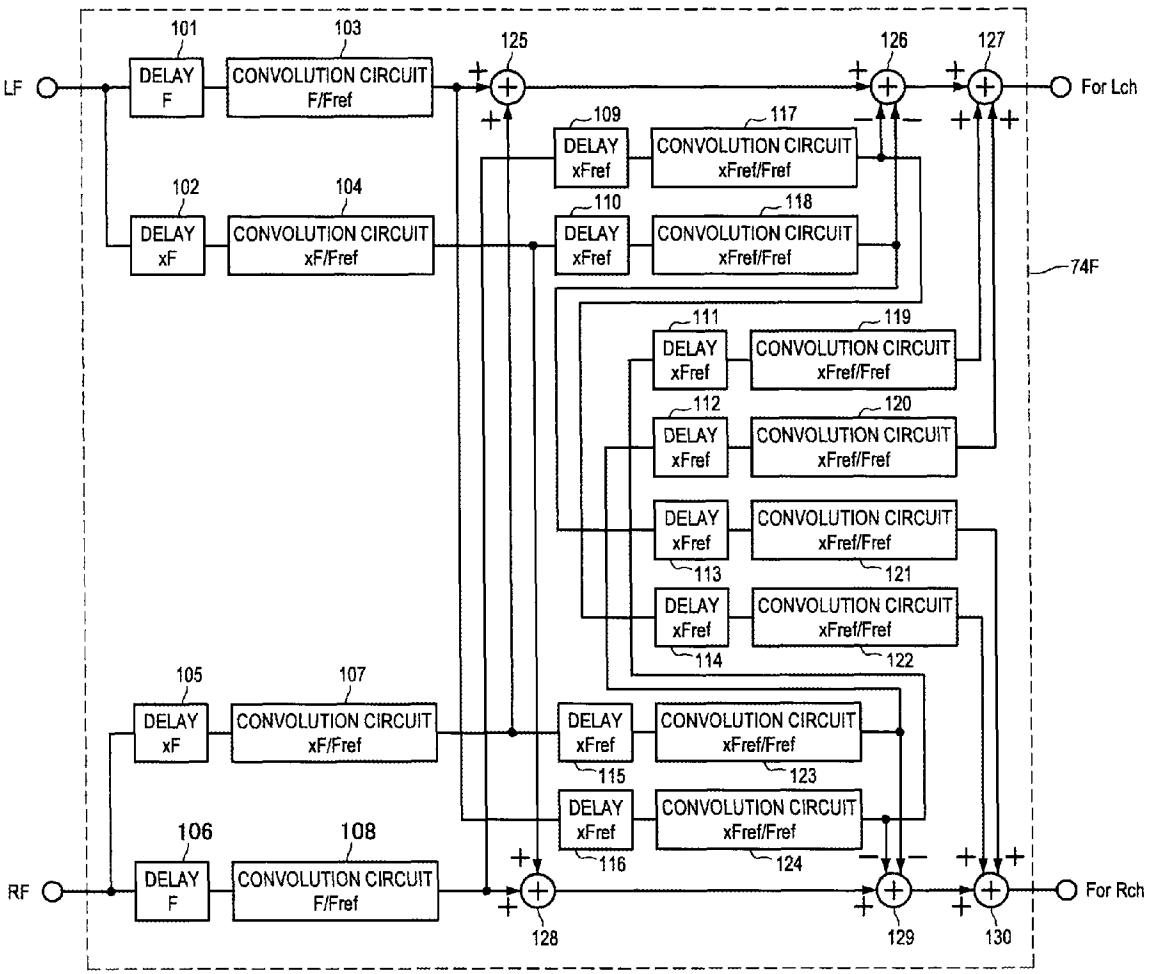
FIG. 10 is an illustrative diagram illustrating an example of an internal configuration of a back processing unit in FIG. 9.
Figure 11:
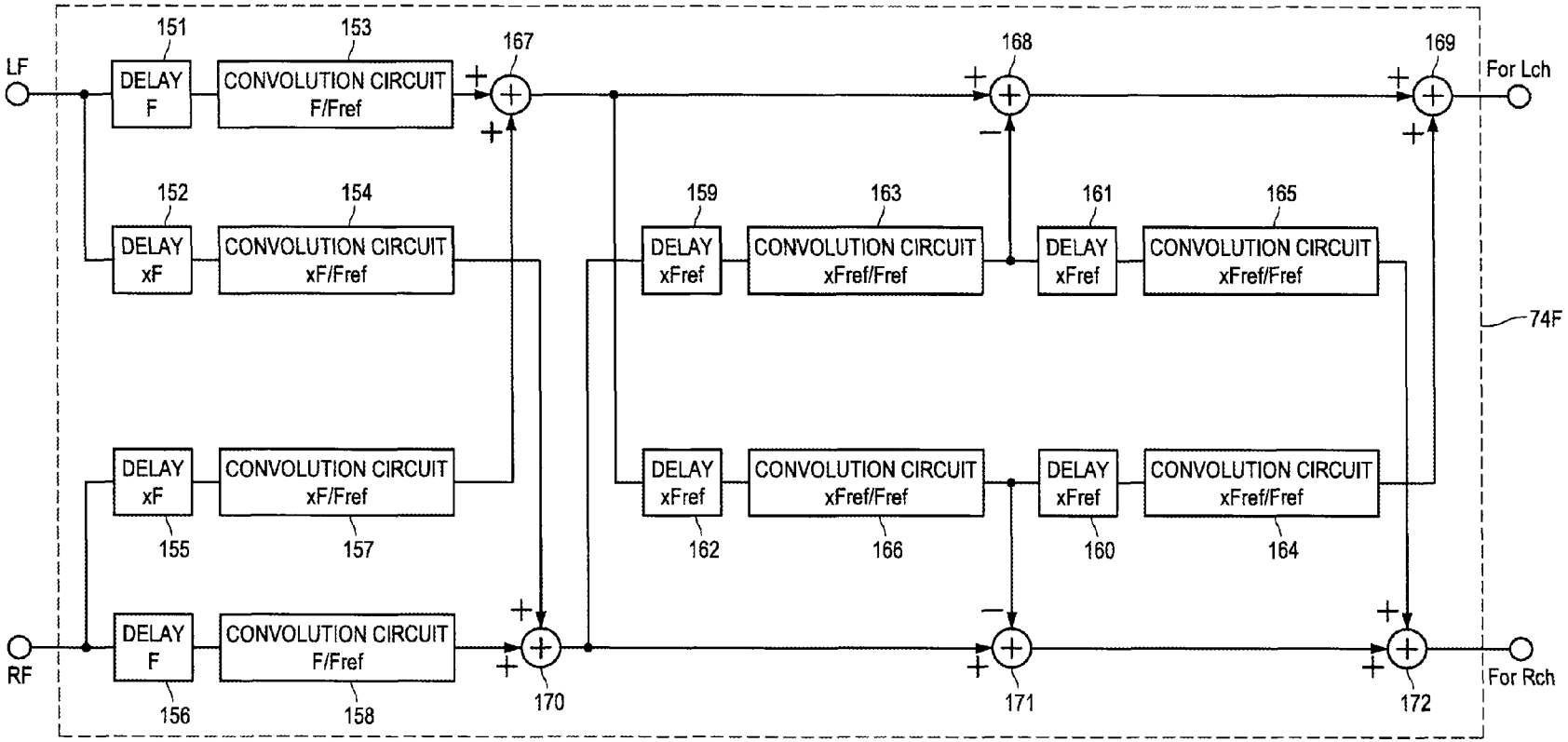
FIG. 11 is an illustrative diagram illustrating another example of an internal configuration of a front processing unit in FIG. 9.
Figure 12:
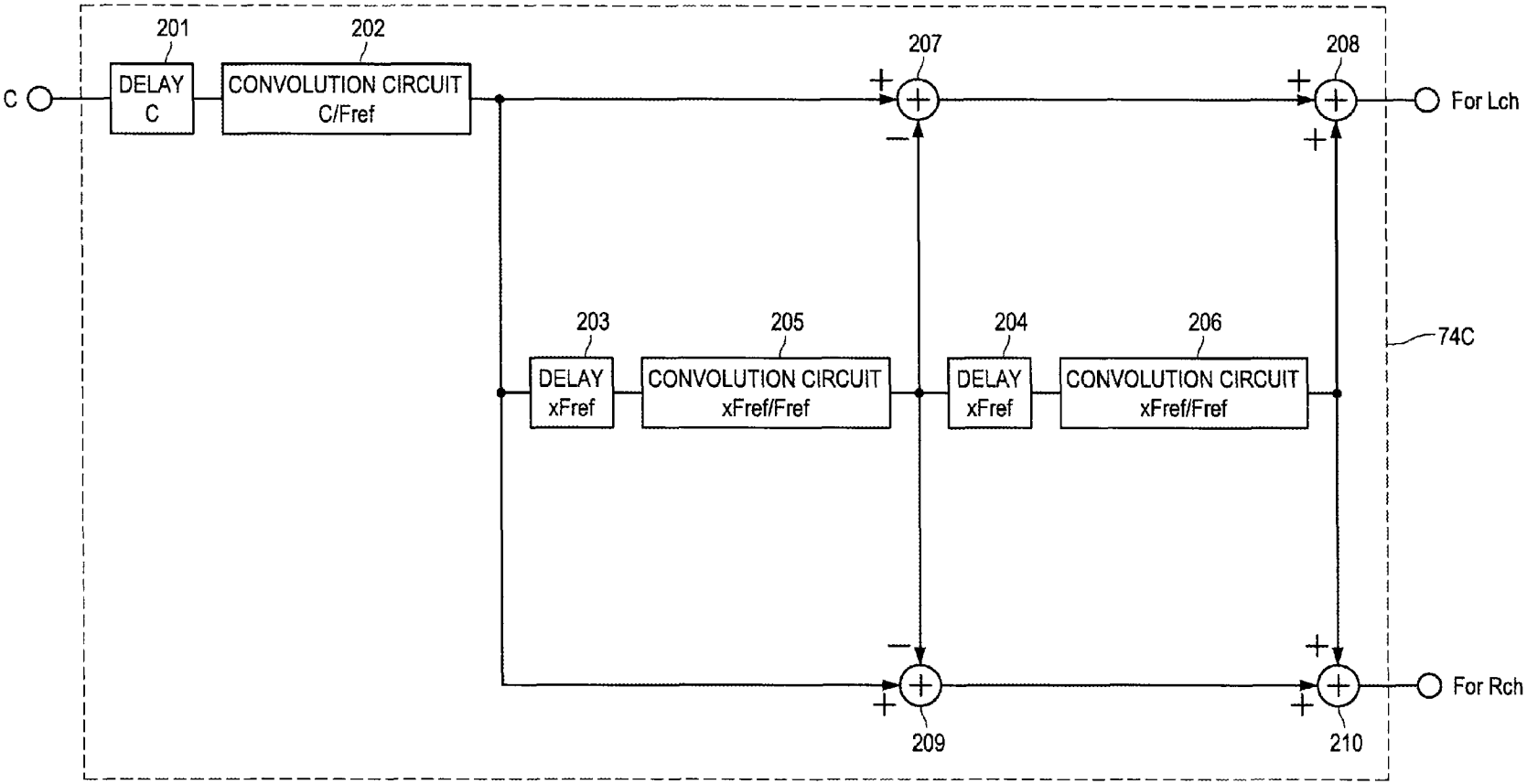
FIG. 12 is an illustrative diagram illustrating an example of an internal configuration of a center processing unit in FIG. 9.
Figure 13:
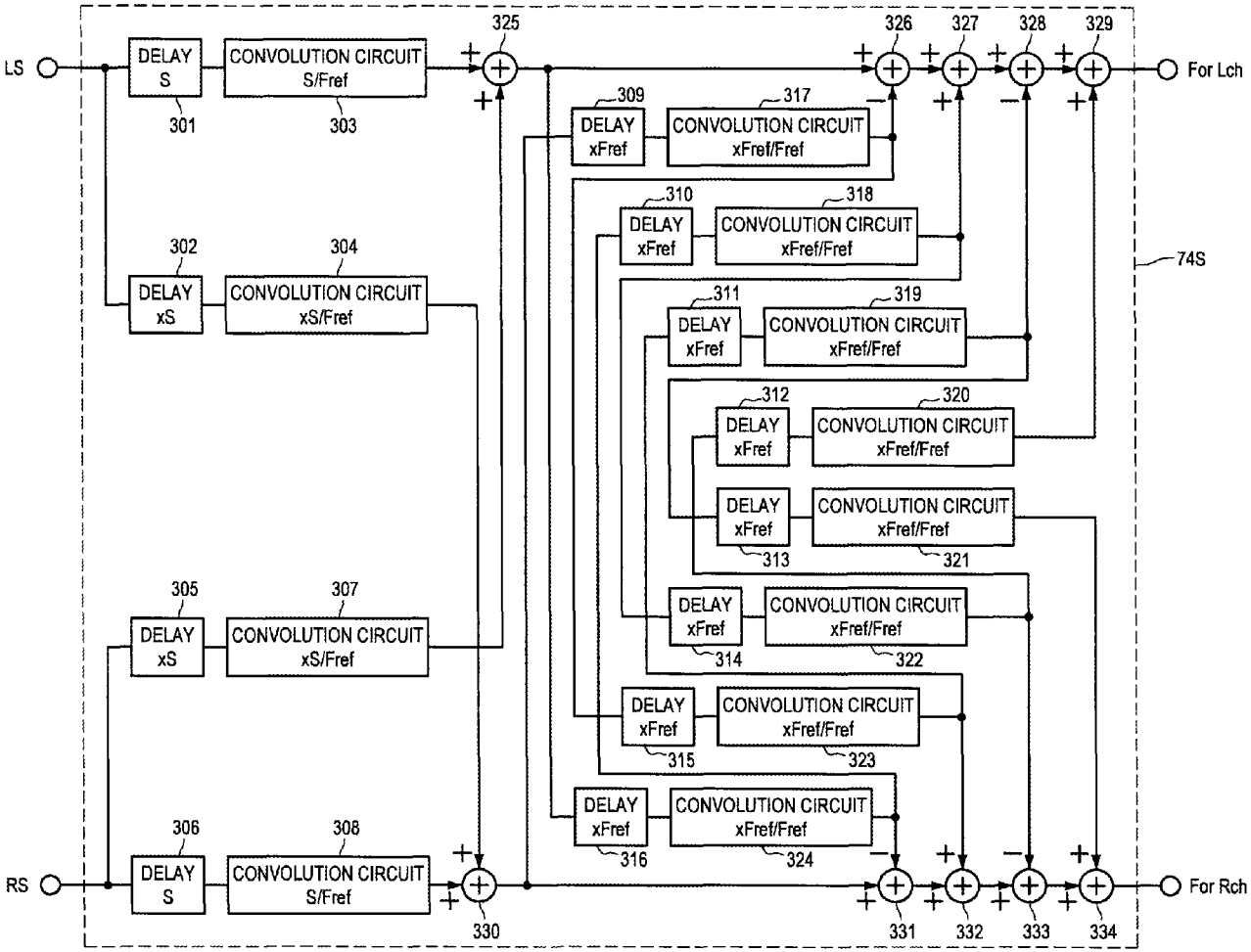
FIG. 13 is an illustrative diagram illustrating an example of an internal configuration of a rear processing unit in FIG. 9.
Figure 14:
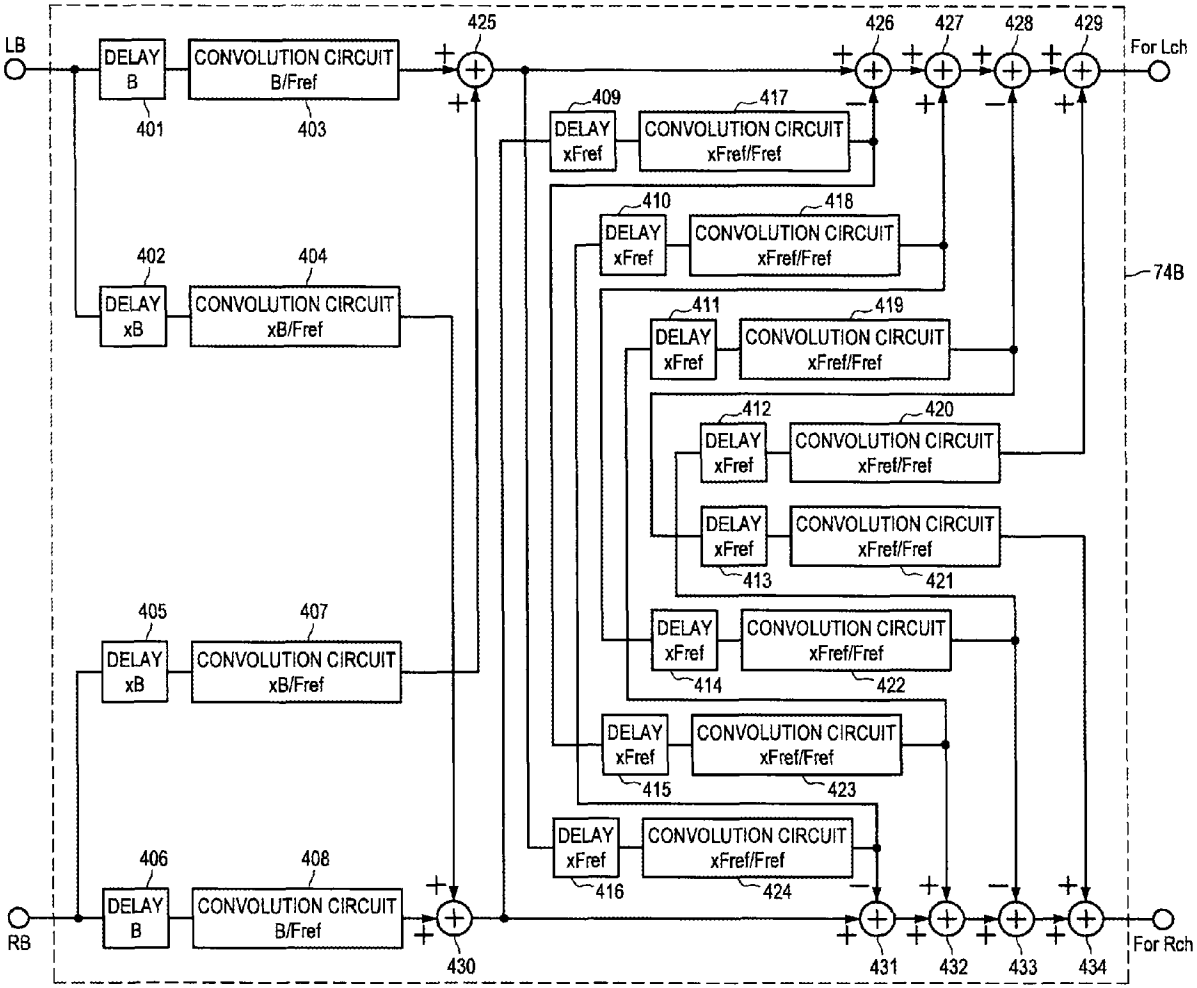
FIG. 14 is an illustrative diagram illustrating an example of an internal configuration of a back processing unit in FIG. 9.
Figure 15:
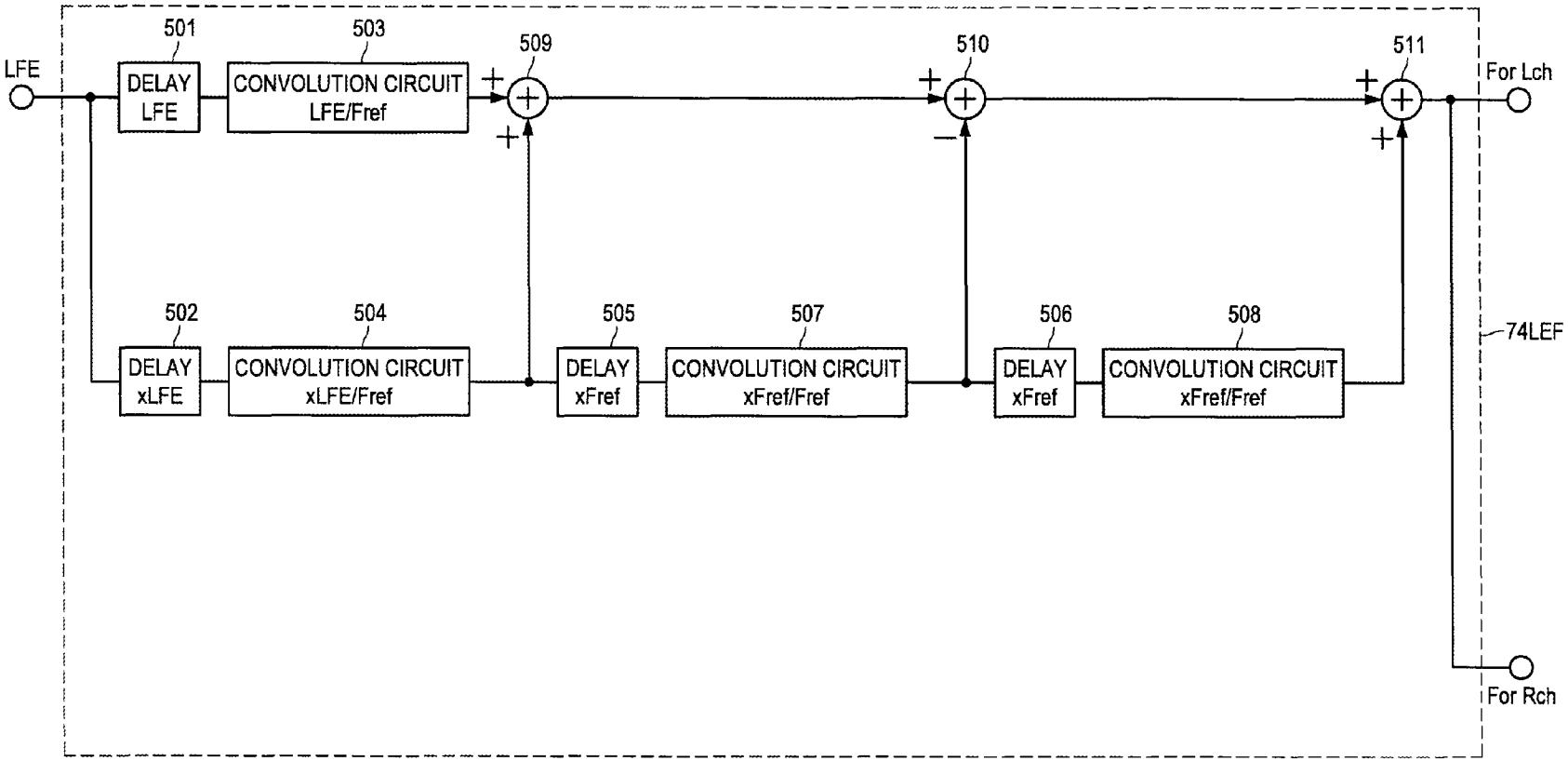
FIG. 15 is an illustrative diagram illustrating an example of an internal configuration of an LFE processing unit in FIG. 9.

FIG. 10 is an illustrative diagram illustrating an example of an internal configuration of the front processing unit 74F in FIG. 9. FIG. 11 is an illustrative diagram illustrating another example of an internal configuration of the front processing unit 74F in FIG. 9. FIG. 12 is an illustrative diagram illustrating an example of an internal configuration of the center processing unit 74C in FIG. 9. FIG. 13 is an illustrative diagram illustrating an example of an internal configuration of the rear processing unit 74S in FIG. 9. FIG. 14 is an illustrative diagram illustrating an example of an internal configuration of the back processing unit 74B in FIG. 9. FIG. 15 is an illustrative diagram illustrating an example of an internal configuration of the LFE processing unit 74LFE in FIG. 9.

In this example, convolution of the normalized head-related transfer function of the direct wave and its crosstalk component is performed on the components LF, LS and LB of the left channel and the components RF, RS and RB of the right channel.

Convolution of the normalized head-related transfer function for the direct wave is also performed on the center channel C. In this example, the crosstalk component is not considered.

Convolution of the normalized head-related transfer function for the direct wave and its crosstalk component is also performed on the LFE channel LFE.

In FIG. 10, the front processing unit 74F includes a head-related transfer function convolution processing unit for a left front channel, a head-related transfer function convolution processing unit for a right front channel, and a crosstalk cancellation processing unit for performing a process of canceling physical crosstalk components in a listener position of the audio signal of the left front channel and the audio signal of the right front channel, on the audio signals.

Figure 16:
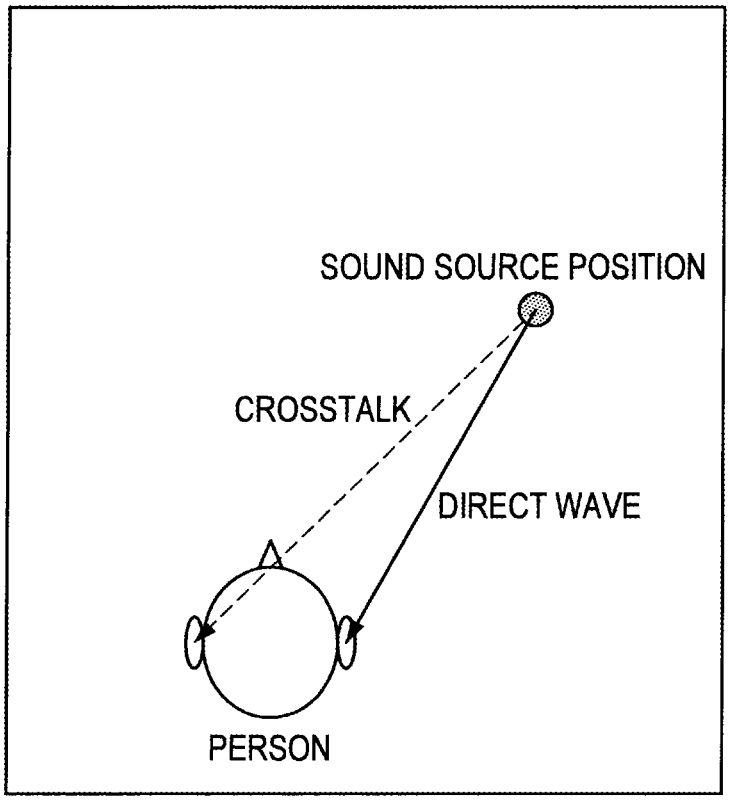
FIG. 16 is a diagram illustrating crosstalk.

Here, a reason for providing the crosstalk cancellation processing unit is that physical crosstalk components, in the listener position, of the audio signals are generated when the audio signals are acoustically reproduced by the left channel speaker SPL and the right channel speaker SPR, as shown in FIG. 16.

The head-related transfer function convolution processing unit for a left front channel includes two delay circuits 101 and 102, and two convolution circuits 103 and 104. The head-related transfer function convolution processing unit for a right front channel includes two delay circuits 105 and 106 and two convolution circuits 107 and 108. The crosstalk cancellation processing unit includes eight delay circuits 109, 110, 111, 112, 113, 114, 115 and 116, eight convolution circuits 117, 118, 119, 120, 121, 122, 123 and 124, and six addition circuits 125, 126, 127, 128, 129 and 130.

The delay circuit 101 and the convolution circuit 103 constitute a convolution processing unit for the signal LF of the direct wave of the left front channel.

The delay circuit 101 is a delay circuit for a delay time according to a length of a path from the virtual sound localization position to the measurement point position, for a direct wave of the left front channel.

The convolution circuit 103 performs a process of convoluting a double-normalized head-related transfer function obtained by normalizing a normalized head-related transfer function for direct waves of the left front channel with the normalized head-related transfer function "Fref" for the direct wave from the positions of the left and right speakers arranged in the television device, for the audio signal LF of the left front channel from the delay circuit 101. In addition, the double-normalized head-related transfer function is stored in the normalized head-related transfer function memory 40 in FIG. 1, and the convolution circuit reads the double-normalized head-related transfer function from the normalized head-related transfer function memory 40 and performs the convolution process.

A signal from the convolution circuit 103 is supplied to the crosstalk cancellation processing unit.

Further, the delay circuit 102 and the convolution circuit 104 constitute a convolution processing unit for a signal xLF of crosstalk of the left front channel toward the right channel (the crosstalk channel of the left front channel).

The delay circuit 102 is a delay circuit for a delay time according to a length of a path from the virtual sound localization position to the measurement point position for the direct wave of the crosstalk channel of the left front channel.

The convolution circuit 104 executes a process of convoluting a double-normalized head-related transfer function obtained by normalizing a normalized head-related transfer function for the direct wave of the crosstalk channel of the left front channel with the normalized head-related transfer function "Fref" for the direct wave from the positions of the left and right speakers arranged in the television device, for the audio signal LF of the left front channel from the delay circuit 102.

A signal from the convolution circuit 104 is supplied to the crosstalk cancellation processing unit.

Further, the delay circuit 105 and the convolution circuit 107 constitute a convolution processing unit for a signal xRF of crosstalk of the right front channel toward the left channel (the crosstalk channel of the right front channel).

The delay circuit 105 is a delay circuit for a delay time according to a length of a path from the virtual sound localization position to the measurement point position for a direct wave of the crosstalk channel of the right front channel.

The convolution circuit 107 executes a process of convoluting a double-normalized head-related transfer function obtained by normalizing a normalized head-related transfer function for direct waves of the crosstalk channel of the right front channel with the normalized head-related transfer function "Fref" for the direct wave from the positions of the left and right speakers arranged in the television device, for the audio signal of the right front channel RF from the delay circuit 105.

A signal from the convolution circuit 107 is supplied to the crosstalk cancellation processing unit.

The delay circuit 106 and the convolution circuit 108 constitute a convolution processing unit for a signal RF of the direct wave of the right front channel.

The delay circuit 106 is a delay circuit for a delay time according to a length of a path from the virtual sound localization position to the measurement point position for the direct wave of the right front channel.

The convolution circuit 108 executes a process of convoluting a double-normalized head-related transfer function obtained by normalizing a normalized head-related transfer function for the direct wave of the right front channel, with the normalized head-related transfer function "Fref" for the direct wave from the positions of the left and right speakers arranged in the television device, for the audio signal of the right front channel RF from the delay circuit 106.

A signal from the convolution circuit 108 is supplied to the crosstalk cancellation processing unit.

The delay circuits 109 to 116, the convolution circuits 117 to 124, and the addition circuits 125 to 130 constitute a crosstalk cancellation processing unit for performing a process of canceling physical crosstalk components in a listener position of the audio signal of the left front channel and the audio signal of the right front channel, on the audio signals.

The delay circuits 109 to 116 are delay circuits for a delay time according to a length of a path from the positions of the left and right speakers to the measurement point position for crosstalk from positions of the left and right speakers arranged in the television device.

The convolution circuits 117 to 124 execute a process of convoluting a double-normalized head-related transfer function obtained by normalizing a normalized head-related transfer function for the crosstalk from the positions of the left and right speakers arranged in the television device, with the normalized head-related transfer function "Fref" for the direct wave from the positions of the left and right speakers arranged in the television device, for the supplied audio signals.

The addition circuits 125 to 130 execute an addition process for the supplied audio signals.

In the front processing unit 74F, a signal output from the addition circuit 127 is supplied to the L addition unit 75L. Further, in the front processing unit 74F, a signal output from the addition circuit 130 is supplied to the R addition unit 75R.

In this example, a delay for distance attenuation and a small level adjustment value resulting from a viewing test in a reproduced sound field are added to the normalized head-related transfer functions convoluted by the convolution circuits 103, 104, 107 and 108.

Further, an audio signal output from the front processing unit 74F shown in FIG. 10 may be represented by the following equations 2 and 3.

$$Lch = LF*D(F)*F(/Fref)+RF*D(xF)*F(xF/Fref)- LF*D(xF)*F(xF/Fref)*K-RF*D(F)*F(F/Fref)*K+ LF*D(F)*F(F/Fref)*K*K+RF*D(xF)*F(xF/Fref)*K*K \quad (2)$$

$$Rch = RF*D(F)*F(F/Fref)+LF*D(xF)*F(xF/Fref)- LF*D(xF)*F(xF/Fref)*K-RF*D(F)*F(F/Fref)*K+ RF*D(F)*F(F/Fref)*K*K+LF*D(xF)*F(xF/Fref)*K*K \quad (3)$$

where the delay process is D( ), the convolution process is F( ), and

D(xFref)*F(xFref/Fref), or the delay process and the convolution process for crosstalk cancellation. is K.

That is, K=D(xFref)*F(xFref/Fref).

While in the present embodiment, the crosstalk cancellation process in the crosstalk cancellation processing unit is performed twice, i.e., two cancellations are performed, a number of repetitions may be changed according to restrictions such as the position of the sound source speaker or a physical room.

In FIG. 11, the front processing unit 74F includes a head-related transfer function convolution processing unit for a left front channel, a head-related transfer function convolution processing unit for a right front channel, and a crosstalk cancellation processing unit for performing a process of canceling physical crosstalk components in a viewing position of the audio signal of the left front channel and the audio signal of the right front channel, on the audio signals.

The head-related transfer function convolution processing unit for a left front channel includes two delay circuits 151 and 152 and two convolution circuits 153 and 154. The head-related transfer function convolution processing unit for a right front channel includes two delay circuits 155 and 156 and two convolution circuits 157 and 158. The crosstalk cancellation processing unit includes four delay circuits 159, 160, 161 and 162, four convolution circuits 163, 164, 165 and 166, and six addition circuits 167, 168, 169, 170, 171 and 172.

In the front processing unit 74F, a signal output from the addition circuit 169 is supplied to the L addition unit 75L. Further, in the front processing unit 74F, a signal output from the addition circuit 172 is supplied to the R addition unit 75R.

Further, an audio signal output from the front processing unit 74F shown in FIG. 11 may be represented by the following equations 4 and 5.

$$Lch=(LF*D(F)*F(F/Fref)+RF*D(xF)*F(xF/Fref))(1-K+K*K) \quad (4)$$

$$Rch=(RF*D(F)*F(F/Fref)+LF*D(xF)*F(xF/Fref))(1-K+K*K) \quad (5)$$

where the delay process is D( ), the convolution process is F( ), and

D(xFref)*F(xFref/Fref), or the delay process and the convolution process for crosstalk cancellation. is K.

That is, K=D(xFref)*F(xFref/Fref).

That is, in the configuration of the front processing unit 74F shown in FIG. 11, a calculation amount can be reduced in comparison with the configuration of the front processing unit 74F shown in FIG. 10.

In FIG. 12, the center processing unit 74C includes a head-related transfer function convolution processing unit for a center channel, and a crosstalk cancellation processing unit for performing a process of canceling a physical crosstalk component in the viewing position of the audio signal of the center channel.

The head-related transfer function convolution processing unit for a center channel includes one delay circuit 201 and one convolution circuit 202. The crosstalk cancellation processing unit includes two delay circuits 203 and 204, two convolution circuits 205 and 206, and four addition circuits 207, 208, 209 and 210.

The delay circuit 201 and the convolution circuit 202 constitute a convolution processing unit for a signal C of a direct wave of the center channel.

The delay circuit 201 is a delay circuit for a delay time according to a length of a path from the virtual sound localization position to the measurement point position for the direct wave of the center channel.

The convolution circuit 202 executes a process of convoluting a double-normalized head-related transfer function obtained by normalizing a normalized head-related transfer function for the direct wave of the center channel, with the normalized head-related transfer function "Fref" for the direct wave from the positions of the left and right speakers arranged in the television device, for the audio signal of the center channel C from the delay circuit 201.

A signal from the convolution circuit 202 is supplied to the crosstalk cancellation processing unit.

The delay circuits 203 and 204, the convolution circuits 205 and 206, and the addition circuits 207 to 210 constitute the crosstalk cancellation processing unit for performing a process of canceling a physical crosstalk component in a viewing position of the audio signal of the center channel.

The delay circuits 203 and 204 are delay circuits for a delay time according to a length of a path from the positions of the left and right speakers to the measurement point position for crosstalk from positions of the left and right speakers arranged in the television device.

The convolution circuits 205 and 206 execute a process of convoluting a double-normalized head-related transfer function obtained by normalizing the normalized head-related transfer function for the crosstalk from the positions of the left and right speakers arranged in the television device, with the normalized head-related transfer function "Fref" for the direct wave from the positions of the left and right speakers arranged in the television device, for the supplied audio signals.

The addition circuits 207 to 210 execute an addition process for the supplied audio signals.

In the center processing unit 74C, a signal output from the addition circuit 208 is supplied to the L addition unit 75L. Further, in the center processing unit 74C, a signal output from the addition circuit 210 is supplied to the R addition unit 75R.

Further, in FIG. 13, the rear processing unit 74S includes a head-related transfer function convolution processing unit for a left rear channel, a head-related transfer function convolution processing unit for a right rear channel, and a crosstalk cancellation processing unit for performing a process of canceling physical crosstalk components in a viewing position of an audio signal of the left rear channel and an audio signal for the right rear channel, on the audio signals.

The head-related transfer function convolution processing unit for a left rear channel includes two delay circuits 301 and 302 and two convolution circuits 303 and 304. The head-related transfer function convolution processing unit for a right rear channel includes two delay circuits 305 and 306 and two convolution circuits 307 and 308. The crosstalk cancellation processing unit includes eight delay circuits 309, 310, 311, 312, 313, 314, 315 and 316, eight convolution circuits 317, 318, 319, 320, 321, 322, 323 and 324, and eight addition circuits 325, 326, 327, 328, 329, 330, 331, 332, 333, and 334.

The delay circuit 301 and the convolution circuit 303 constitute a convolution processing unit for a signal LS of a direct wave of the left rear channel.

The delay circuit 301 is a delay circuit for a delay time according to a length of a path from the virtual sound localization position to the measurement point position for the direct wave of the left rear channel.

The convolution circuit 303 executes a process of convoluting a double-normalized head-related transfer function obtained by normalizing a normalized head-related transfer function for direct waves of the left rear channel, with the normalized head-related transfer function "Fref" for the direct wave from the positions of the left and right speakers arranged in the television device, for the audio signal LS of the left rear channel from the delay circuit 301.

A signal from the convolution circuit 303 is supplied to the crosstalk cancellation processing unit.

Further, the delay circuit 302 and the convolution circuit 304 constitute a convolution processing unit for a signal xLS of crosstalk of the left rear channel toward the right channel (the crosstalk channel of the left rear channel).

The delay circuit 302 is a delay circuit for a delay time according to a length of a path from the virtual sound localization position to the measurement point position for the direct wave of the crosstalk channel of the left rear channel.

The convolution circuit 304 executes a process of convoluting a double-normalized head-related transfer function obtained by normalizing the normalized head-related transfer function for the direct wave of the crosstalk channel of the left rear channel, with the normalized head-related transfer function "Fref" for the direct wave from the positions of the left and right speakers arranged in the television device, for the audio signal LS of the left rear channel from the delay circuit 302.

A signal from this convolution circuit 304 is supplied to the crosstalk cancellation processing unit.

Further, the delay circuit 305 and the convolution circuit 307 constitute a convolution processing unit for a signal xRS of crosstalk of the right rear channel toward the left channel (the crosstalk channel of the right rear channel).

The delay circuit 305 is a delay circuit for a delay time according to a length of a path from the virtual sound localization position to the measurement point position for the direct wave of the crosstalk channel of the right rear channel.

The convolution circuit 307 executes a process of convoluting a double-normalized head-related transfer function obtained by normalizing the normalized head-related transfer function for the direct wave of the crosstalk channel of the right rear channel, with the normalized head-related transfer function "Fref" for the direct wave from the positions of the left and right speakers arranged in the television device, for the audio signal RS of the right rear channel from the delay circuit 305.

A signal from the convolution circuit 307 is supplied to the crosstalk cancellation processing unit.

The delay circuit 306 and the convolution circuit 308 constitute a convolution processing unit for the signal RS of the direct wave of the right rear channel.

The delay circuit 306 is a delay circuit for a delay time according to a length of a path from the virtual sound localization position to the measurement point position for the direct wave of the right rear channel.

The convolution circuit 308 executes a process of convoluting a double-normalized head-related transfer function obtained by normalizing the normalized head-related transfer function for the direct wave of the right rear channel, with the normalized head-related transfer function "Fref" for the direct wave from the positions of the left and right speakers arranged in the television device, for the audio signal RS of the right rear channel from the delay circuit 306.

A signal from the convolution circuit 308 is supplied to the crosstalk cancellation processing unit.

The delay circuits 309 to 316, the convolution circuits 317 to 324, and the addition circuits 325 to 334 constitute the crosstalk cancellation processing unit for performing a cancellation process of physical crosstalk components in a listener position of the audio signal of the left rear channel and the audio signal of the right rear channel, on the audio signals.

The delay circuits 309 to 316 are delay circuits of a delay time according to a length of a path from the positions of the left and right speakers to the measurement point position for crosstalk from positions of the left and right speakers arranged in the television device.

The convolution circuits 317 to 324 execute a process of convoluting a double-normalized head-related transfer function obtained by normalizing the normalized head-related transfer function for crosstalk from positions of the left and right speakers arranged in the television device, with the normalized head-related transfer function "Fref" for the direct wave from the positions of the left and right speakers arranged in the television device, for the supplied audio signals.

The addition circuits 325 to 334 execute an addition process for the supplied audio signals.

In the rear processing unit 74S, a signal output from the addition circuit 329 is supplied to the L addition unit 75L. Further, in the rear processing unit 74S, a signal output from the addition circuit 334 is supplied to the R addition unit 75R.

While in the present embodiment, the crosstalk cancellation process is performed four times by the crosstalk cancellation processing unit, i.e., four cancellations are performed, a number of repetitions may be changed according to restrictions such as the position of the sound source speaker or a physical room.

Further, in FIG. 14, the back processing unit 74B includes a head-related transfer function convolution processing unit for a left rear channel, a head-related transfer function convolution processing unit for a right rear channel, and a crosstalk cancellation processing unit for performing a process of canceling physical crosstalk components in a viewing position of the audio signal of the left rear channel and the audio signal of the right rear channel, on the audio signals.

The head-related transfer function convolution processing unit for a left rear channel includes two delay circuits 401 and 402 and two convolution circuits 403 and 404. The head-related transfer function convolution processing unit for a right rear channel includes two delay circuits 405 and 406 and two convolution circuits 407 and 408. The crosstalk cancellation processing unit includes eight delay circuits 409, 410, 411, 412, 413, 414, 415 and 416, eight convolution circuits 417, 418, 419, 420, 421, 422, 423 and 424, and eight addition circuits 425, 426, 427, 428, 429, 430, 431, 432, 433 and 434.

The delay circuit 401 and the convolution circuit 403 constitute a convolution processing unit for the signal LB of the direct wave of the left rear channel.

The delay circuit 401 is a delay circuit for a delay time according to a length of a path from the virtual sound localization position to the measurement point position for the direct wave of the left rear channel.

The convolution circuit 403 executes a process of convoluting a double-normalized head-related transfer function obtained by normalizing a normalized head-related transfer function for direct waves of the left rear channel, with the normalized head-related transfer function "Fref" for the direct wave from the positions of the left and right speakers arranged in the television device, for the audio signal of the left rear channel LB from the delay circuit 401.

A signal from the convolution circuit 403 is supplied to the crosstalk cancellation processing unit.

Further, the delay circuit 402 and the convolution circuit 404 constitute a convolution processing unit for a signal xLB of crosstalk of the left rear channel toward the right channel (the crosstalk channel of the left rear channel).

The delay circuit 402 is a delay circuit for a delay time according to a length of a path from the virtual sound localization position to the measurement point position for the direct wave of the crosstalk channel of the left rear channel.

The convolution circuit 404 executes a process of convoluting a double-normalized head-related transfer function obtained by normalizing the normalized head-related transfer function for the direct wave of the crosstalk channel of the left rear channel, with the normalized head-related transfer function "Fref" for the direct wave from the positions of the left and right speakers arranged in the television device, for the audio signal of the left rear channel LB from the delay circuit 402.

A signal from the convolution circuit 404 is supplied to the crosstalk cancellation processing unit.

The delay circuit 405 and the convolution circuit 407 constitute a convolution processing unit for a signal xRB of crosstalk of the right rear channel toward the left channel (the crosstalk channel of the right rear channel).

The delay circuit 405 is a delay circuit for a delay time according to a length of a path from the virtual sound localization position to the measurement point position for the direct wave of the crosstalk channel of the right rear channel.

The convolution circuit 407 executes a process of convoluting a double-normalized head-related transfer function obtained by normalizing the normalized head-related transfer function for the direct wave of the crosstalk channel of the right rear channel, with the normalized head-related transfer function "Fref" for the direct wave from the positions of the left and right speakers arranged in the television device, for the audio signal of the right rear channel RB from the delay circuit 405.

A signal from the convolution circuit 407 is supplied to the crosstalk cancellation processing unit.

The delay circuit 406 and the convolution circuit 408 constitute a convolution processing unit for a signal RB of the direct wave of the right rear channel.

The delay circuit 406 is a delay circuit for a delay time according to a length of a path from the virtual sound localization position to the measurement point position for the direct wave of the right rear channel.

The convolution circuit 408 executes a process of convoluting a double-normalized head-related transfer function obtained by normalizing a normalized head-related transfer function for the direct wave of the right rear channel, with the normalized head-related transfer function "Fref" for the direct wave from the positions of the left and right speakers arranged in the television device, for the audio signal of the right rear channel RB from the delay circuit 406.

A signal from the convolution circuit 408 is supplied to the crosstalk cancellation processing unit.

The delay circuits 409 to 416, the convolution circuits 417 to 424, and the addition circuits 425 to 434 constitute the crosstalk cancellation processing unit for performing a process of canceling physical crosstalk components in a listener position of the audio signal of the left rear channel and the audio signal of the right rear channel, on the audio signals.

The delay circuits 409 to 416 are delay circuits for a delay time according to a length of a path from the positions of the left and right speakers to the measurement point position for crosstalk from positions of the left and right speakers arranged in the television device.

The convolution circuits 417 to 424 execute a process of convoluting a double-normalized head-related transfer function obtained by normalizing a normalized head-related transfer function for crosstalk from positions of the left and right speakers arranged in the television device, with the normalized head-related transfer function "Fref" for the direct wave from the positions of the left and right speakers arranged in the television device, for the supplied audio signal.

The addition circuits 425 to 434 execute an addition process for the supplied audio signals.

In the back processing unit 74B, a signal output from the addition circuit 429 is supplied to the L addition unit 75L. Further, in the back processing unit 74B, a signal output from the addition circuit 434 is supplied to the R addition unit 75R.

In FIG. 15, the LFE processing unit 74LFE includes a head-related transfer function convolution processing unit for an LFE channel, and a crosstalk cancellation processing unit for performing a process of canceling a physical crosstalk component in the viewing position of the audio signal of the LFE channel.

The head-related transfer function convolution processing unit for an LFE channel includes two delay circuits 501 and 502 and two convolution circuits 503 and 504. The crosstalk cancellation processing unit includes two delay circuits 505 and 506, two convolution circuits 507 and 508, and three addition circuits 509, 510 and 511.

The delay circuit 501 and the convolution circuit 503 constitute a convolution processing unit for a signal C of the direct wave of the LFE channel.

The delay circuit 501 is a delay circuit for a delay time according to a length of a path from the virtual sound localization position to the measurement point position for the direct wave of the LFE channel.

The convolution circuit 503 executes a process of convoluting a double-normalized head-related transfer function obtained by normalizing the normalized head-related transfer function for the direct wave of the LFE channel, with the normalized head-related transfer function "Fref" for the direct wave from the positions of the left and right speakers arranged in the television device, for the audio signal LFE of the LFE channel from the delay circuit 501.

A signal from the convolution circuit 503 is supplied to the crosstalk cancellation processing unit.

Further, the delay circuit 502 is a delay circuit for a delay time according to a length of a path from the virtual sound localization position to the measurement point position for the crosstalk of the direct wave of the LFE channel.

The convolution circuit 504 executes a process of convoluting a double-normalized head-related transfer function obtained by normalizing a normalized head-related transfer function for the crosstalk of the direct wave of the LFE channel, with the normalized head-related transfer function "Fref" for the direct wave from the positions of the left and right speakers arranged in the television device, for the audio signal LFE of the LFE channel from the delay circuit 502.

A signal from the convolution circuit 504 is supplied to the crosstalk cancellation processing unit.

The delay circuits 505 and 506, the convolution circuits 507 and 508, and the addition circuits 509 to 511 constitute the crosstalk cancellation processing unit for performing a process of canceling a physical crosstalk component in the viewing position of the audio signal of the LFE channel.

The delay circuits 505 and 506 are delay circuits for a delay time according to a length of a path from the positions of the left and right speakers to the measurement point position for crosstalk from positions of the left and right speakers arranged in the television device.

The convolution circuits 507 and 508 execute a process of convoluting a double-normalized head-related transfer function obtained by normalizing a normalized head-related transfer function for crosstalk from positions of the left and right speakers arranged in the television device, with the normalized head-related transfer function "Fref" for the direct wave from the positions of the left and right speakers arranged in the television device, for the supplied audio signal.

The addition circuits 509 to 511 execute an addition process for the supplied audio signals.

In the LFE processing unit 74LFE, a signal output from the addition circuit 511 is supplied to the L addition unit 75L and the R addition unit 75R.

According to the present embodiment, all normalized head-related transfer functions are normalized with the normalized head-related transfer function for direct waves from the positions of the left and right speakers arranged in the television device, and the convolution process is performed on the audio signal using the double-normalized head-related transfer function, thereby producing an ideal surround effect.

Figure 18:
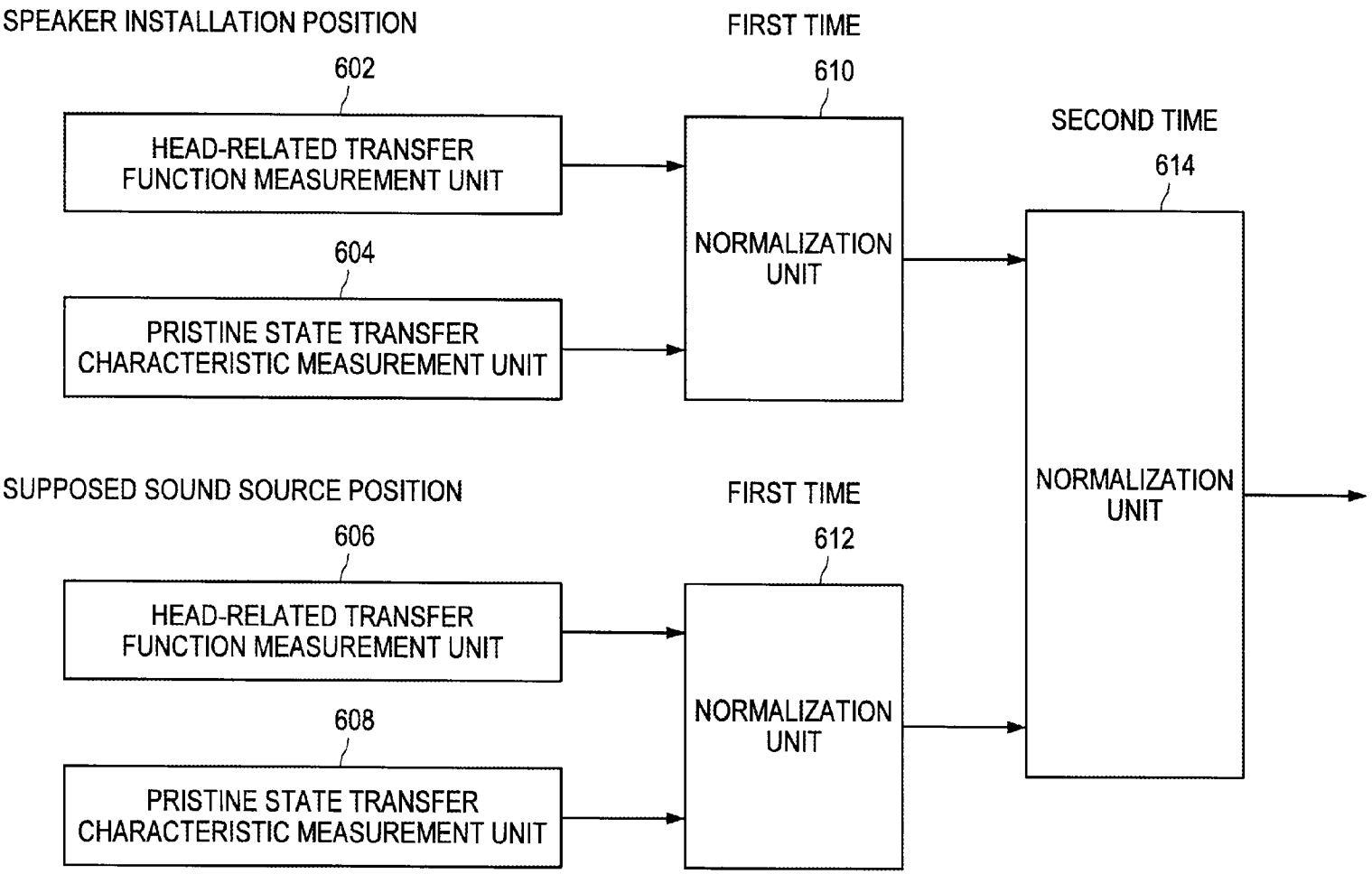
FIG. 18 is a block diagram showing an example of a configuration of a system that executes a processing procedure for acquiring data of a double-normalized head-related transfer function used in an audio signal processing method in an embodiment of the present invention.

FIG. 18 is a block diagram showing an example of a configuration of a system for executing a processing procedure for acquiring data of a double-normalized head-related transfer function used in the audio signal processing method in an embodiment of the present invention.

In a head-related transfer function measurement unit 602, in this example, measurement of the head-related transfer function is performed in an anechoic chamber in order to measure a head-related transfer characteristic of only direct waves. For the head-related transfer function measurement unit 602, a dummy head or a person is arranged as a listener in a listener position in the anechoic chamber as in FIG. 20 described above. Microphones are installed as acoustic-electric conversion units receiving a sound wave for measurement near both ears of the dummy head or the person (in the measurement point position).

Figure 19:
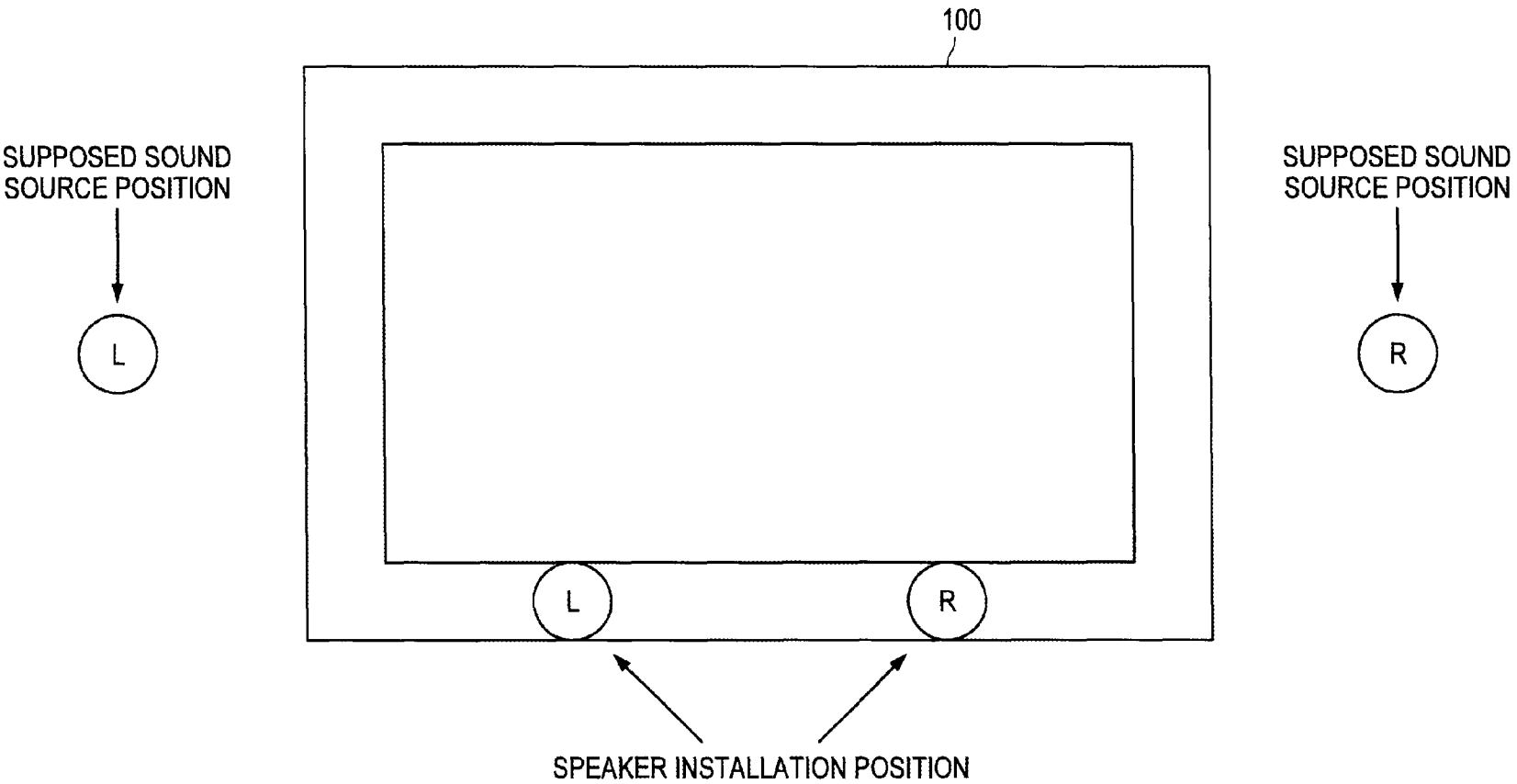
FIG. 19 is a diagram used to illustrate speaker installation positions and supposed sound source positions.

As shown in FIG. 19, sound waves for measurement of the head-related transfer function, such as impulses in this example, are separately reproduced by left and right speakers installed in speaker installation positions of a television device 100, and the impulse responses are picked up by the two microphones.

In the head-related transfer function measurement unit 602, the impulse responses obtained from the two microphones represent the head-related transfer functions.

In a pristine state transfer characteristic measurement unit 604, measurement of a transfer characteristic of a pristine state in which the dummy head or the person is not present in the listener position, i.e., an obstacle is not present between the sound source position for measurement and the measurement point position, is performed in the same environment as for the head-related transfer function measurement unit 602.

That is, for the pristine state transfer characteristic measurement unit 604, a pristine state is prepared in which the obstacle is not present between the left and right speakers installed in the speaker installation positions of the television device 100 and the microphones, with the dummy head or the person installed for the head-related transfer function measurement unit 602 removed from the anechoic chamber.

An arrangement of the left and right speakers installed in the speaker installation positions of the television device 100 or the microphones is completely the same as that in the head-related transfer function measurement unit 602, and in this state, sound waves for measurement, such as impulses in this example, are separately reproduced by the left and right speakers installed in the speaker installation positions of the television device 100. The two microphones pick up the reproduced impulses.

In the pristine state transfer characteristic measurement unit 604, the impulse responses obtained from outputs of the two microphones represent transfer characteristics in the pristine state in which an obstacle such as a dummy head or a person is not present.

In addition, in the head-related transfer function measurement unit 602 and the pristine state transfer characteristic measurement unit 604, for the direct wave, the head-related transfer functions and the pristine state transfer characteristics of the left and right main components described above, and the head-related transfer functions and the pristine state transfer characteristics of the left and right crosstalk components are obtained from the respective two microphones. A normalization process, which will be described below, is similarly performed on each of the main components and the left and right crosstalk components.

Hereinafter, for simplification of a description, for example, the normalization process for only the main components will be described, and a description of the normalization process for the crosstalk components will be omitted. Needless to say, the normalization process is similarly performed on the crosstalk components.

The normalization unit 610 normalizes the head-related transfer function measured with the dummy head or the person by the head-related transfer function measurement unit 602, using the transfer characteristic of the pristine state in which the obstacle such as the dummy head is not present, which has been measured by the pristine state transfer characteristic measurement unit 604.

A head-related transfer function measurement unit 606 performs, in this example, measurement of the head-related transfer function in the anechoic chamber in order to measure the head-related transfer characteristic of only the direct wave. In the head-related transfer function measurement unit 606, as in FIG. 20 described above, the dummy head or the person is arranged as the listener in the listener position in the anechoic chamber. Microphones are installed as acoustic-electric conversion units receiving the sound wave for measurement near both ears of the dummy head or the person (measurement point position).

As shown in FIG. 19, sound waves for measurement of the head-related transfer function, such as impulses in this example, are separately reproduced by the left and right speakers installed in the supposed sound source positions, and impulse responses are picked up by the two microphones.

In the head-related transfer function measurement unit 606, the impulse responses obtained from the two microphones represent head-related transfer functions.

A pristine state transfer characteristic measurement unit 608 performs measurement of the transfer characteristic of the pristine state in which the dummy head or the person is not present in the listener position, i.e., the obstacle is not present between the sound source position for measurement and the measurement point position, in the same environment as for the head-related transfer function measurement unit 606.

That is, for the pristine state transfer characteristic measurement unit 608, a pristine state is prepared in which the obstacle is not present between the left and right speakers installed in the supposed sound source positions shown in FIG. 19 and the microphones, with the dummy head or the person installed for the head-related transfer function measurement unit 606 removed from the anechoic chamber.

An arrangement of the left and right speakers arranged in the supposed sound source positions shown in FIG. 19 or the microphones is completely the same as that in the head-related transfer function measurement unit 606, and in this state, sound waves for measurement, such as impulses in this example, are separately reproduced by the left and right speakers arranged in the supposed sound source positions shown in FIG. 19. The two microphones pick up the reproduced impulses.

In the pristine state transfer characteristic measurement unit 608, the impulse responses obtained from outputs of the two microphones represent transfer characteristics in the pristine state in which the obstacle such as the dummy head or the person is not present.

In addition, in the head-related transfer function measurement unit 606 and the pristine state transfer characteristic measurement unit 608, for the direct wave, the head-related transfer functions and the pristine state transfer characteristics of the left and right main components described above, and the head-related transfer functions and the pristine state transfer characteristics of the left and right crosstalk components are obtained from the respective two microphones. A normalization process, which will be described below, is similarly performed on each of the main components and the left and right crosstalk components.

Hereinafter, for simplification of a description, for example, the normalization process for only the main components will be described, and a description of the normalization process for the crosstalk components will be omitted. Needless to say, the normalization process is similarly performed on the crosstalk components.

The normalization unit 612 normalizes the head-related transfer function measured with the dummy head or the person by the head-related transfer function measurement unit 606, using the transfer characteristic of the pristine state in which the obstacle such as the dummy head is not present, which has been measured by the pristine state transfer characteristic measurement unit 608.

A normalization unit 614 normalizes the normalized head-related transfer function in the supposed sound source position normalized by the normalization unit 612, using the normalized head-related transfer function in the speaker installation position normalized by the normalization unit 610. By doing so, it is possible to acquire the data of the double-normalized head-related transfer function used in the audio signal processing method in the present embodiment.

In addition, in the present embodiment, the surround signals are handled. However, usually, when stereo signals are used, the respective stereo signals may be input to the front processing unit 74F, and no signal may be input to the other processing units or the other processing units may not perform processing. Even in this case, a stereo image can produce a sound image in a wider space than a real television device in the same position as a supposed screen rather than speakers of the television device.

According to the present embodiment, it is possible to obtain an excellent surround effect by using any two front speakers.

Further, when speakers in a television device, a theater rack, or the like are used as output devices, a sound image matching a height of an image rather than positions of the speakers can be produced. Thereby, for a stereo signal, a sound field can be formed as if left and right speakers, at a height matching the image, of the television device were arranged, and for a surround signal, a sound field can be formed as if it were surrounded by speakers.

Further, when the audio signal processing device of the present embodiment is applied to a small radio cassette recorder or a portable music player, a dock of the recorder or the player may form a wider sound field than a small distance between speakers. Similarly, even when a movie is viewed using a portable Blu-ray disc (BD)/a DVD player, a notebook PC, or the like, a sound field matching an image of the movie can be formed.

In the above embodiment, the convolution of the head-related transfer function according to any desired listening or room environment can be performed, and the head-related transfer function allowing the characteristics of the microphones for measurement or the speakers for measurement to be eliminated has been used as a head-related transfer function for a desired virtual sound localization sense.

However, the invention is not limited to the case in which such a special head-related transfer function is used, but the invention may be applied to the case in which a general head-related transfer function is convoluted.

While the acoustic reproduction system has been described in connection with the multi surround scheme, it is understood that the present invention may be applied to a case in which a typical 2-channel stereo is subjected to a virtual sound localization process and supplied to, for example, speakers arranged in a television device.

Further, it is understood that the present invention may be applied to other multi surrounds such as 5.1 channels or 9.1 channels, as well as 7.1 channels.

While the speaker arrangement for the 7.1 channel multi surround has been described in connection with the ITU-R speaker arrangement, it is understood that the present invention may be applied to the speaker arrangement recommended by THX, Inc.

Further, the object of the present invention is achieved by supplying a storage medium having a program code of software that realizes the functionality of the above-described embodiment stored thereon, to a system or a device, and by a computer (or a CPU or a MPU) of the system or the device reading and executing the program code stored in the storage medium.

In this case, the program code read from the storage medium realizes the functionality of the above-described embodiment, such that the program code and the storage medium having the program code stored thereon constitute the present invention.

For example, a floppy (registered trade mark) disk, a hard disk, a magneto-optical disc, an optical disc such as a CD-ROM, a CD-R, a CD-RW, a DVD-ROM, a DVD-RAM, a DVD-RW and a DVD+RW, a magnetic tape, a nonvolatile memory card, a ROM, and the like may be used as the storage medium for supplying the program code. Alternatively, the program code may be downloaded via a network.

Further, the functionality of the above-described embodiment is not only realized by executing program code read by a computer, but also by a real process by, for example, an operating system (OS) run on the computer performing part or all of the real process based on an instruction of the program code.

Alternatively, the functionality of the above-described embodiment may be realized by writing the program code read from the storage medium to a memory that is included in a functionality expansion board inserted into the computer or a functionality expansion unit connected to the computer, and then by the process by a CPU included in the expansion board or the expansion unit performing part or all of the real process based on an instruction of the program code.

It should be understood by those skilled in the art that various modifications, combinations, sub-combinations and alterations may occur depending on design requirements and other factors insofar as they are within the scope of the appended claims or the equivalents thereof.

The present application contains subject matter related to that disclosed in Japanese Priority Patent Application JP 2010-116150 filed in the Japan Patent Office on May 20, 2010, the entire content of which is hereby incorporated by reference.

What is claimed is:

1. An audio signal processing device, comprising:

a first circuit to receive a plurality of input audio signals corresponding to respective virtual sound source positions, the plurality of input audio signals including at least a first input audio signal corresponding to a first virtual sound source position; and a first convolution circuit to generate, based on the first input audio signal and a first double-normalized head-related transfer function (HRTF), a first channel audio signal to be output from a first speaker, wherein the first double-normalized HRTF is obtained by normalizing a first normalized HRTF corresponding to the first sound source position with a second normalized HRTF corresponding to a position of the first speaker.

2. The audio signal processing device of claim 1, further comprising:

a second convolution circuit to generate, based on the first input audio signal and a second double-normalized HRTF, a second channel audio signal to be output from a second speaker, wherein the second double-normalized HRTF is obtained by normalizing the first normalized HRTF corresponding to the first sound source position with a third normalized HRTF corresponding to a position of the second speaker.

3. The audio signal processing device of claim 1, wherein the first normalized HRTF is obtained by normalizing a first dummy-head HRTF with a first pristine state HRTF, the dummy-head HRTF obtained based on measurements, made at a location near and in the presence of a dummy head, of sound waves transmitted from the first virtual sound source position, the pristine state HRTF obtained based on measurements, made at the location and without the dummy head present, of the sound waves transmitted from the first virtual sound source position.

4. The audio signal processing device of claim 3, wherein the second normalized HRTF is obtained by normalizing a second dummy-head HRTF with a second pristine state HRTF, the second dummy-head HRTF obtained based on measurements, made at the location near and in the presence of the dummy head, of sound waves transmitted from the position of the first speaker, the pristine state HRTF obtained based on measurements, made at the location and without the dummy head present, of the sound waves transmitted from the position of the first speaker.

5. The audio signal processing device of claim 1, the device comprising at least one circuit to calculate the first double-normalized HRTF.

6. The audio signal processing device of claim 1, further comprising:

a storage unit configured to store the first double-normalized HRTF, wherein the first convolution circuit is further configured to access the first double-normalized HRTF stored in the storage unit.

7. The audio signal processing device of claim 2, the device comprising at least one circuit to perform cross-talk cancellation for the first channel audio signal and the second channel audio signal.

8. An audio signal processing method, comprising:

using at least one circuit to perform acts of:

receiving a plurality of input audio signals corresponding to respective virtual sound source positions, the plurality of input audio signals including at least a first input audio signal corresponding to a first virtual sound source position; and generating, based on the first input audio signal and a first double-normalized head-related transfer function (HRTF), a first channel audio signal to be output from a first speaker, wherein the first double-normalized HRTF is obtained by normalizing a first normalized HRTF corresponding to the first sound source position with a second normalized HRTF corresponding to a position of the first speaker.

9. The audio signal processing method of claim 8, further comprising using the at least on circuit to perform acts of:

generating, based on the first input audio signal and a second double-normalized HRTF, a second channel audio signal to be output from a second speaker, wherein the second double-normalized HRTF is obtained by normalizing the first normalized HRTF corresponding to the first sound source position with a third normalized HRTF corresponding to a position of the second speaker.

10. The audio signal processing method of claim 8, wherein the first normalized HRTF is obtained by normalizing a first dummy-head HRTF with a first pristine state HRTF, the dummy-head HRTF obtained based on measurements, made at a location near and in the presence of a dummy head, of sound waves transmitted from the first virtual sound source position, the pristine state HRTF obtained based on measurements, made at the location and without the dummy head present, of the sound waves transmitted from the first virtual sound source position.

11. The audio signal processing method of claim 10, wherein the second normalized HRTF is obtained by normalizing a second dummy-head HRTF with a second pristine state HRTF, the second dummy-head HRTF obtained based on measurements, made at the location near and in the presence of the dummy head, of sound waves transmitted from the position of the first speaker, the pristine state HRTF obtained based on measurements, made at the location and without the dummy head present, of the sound waves transmitted from the position of the first speaker.

12. The audio signal processing method of claim 8, further comprising calculating the first double-normalized HRTF.

13. The audio signal processing method of claim 9, further comprising performing cross-talk cancellation for the first channel audio signal and the second channel audio signal.

14. An audio signal processing device, comprising:

a means for receiving a plurality of input audio signals corresponding to respective virtual sound source positions, the plurality of input audio signals including at least a first input audio signal corresponding to a first virtual sound source position; and a means for generating, based on the first input audio signal and a first double-normalized head-related transfer function (HRTF), a first channel audio signal to be output from a first speaker, wherein the first double-normalized HRTF is obtained by normalizing a first normalized HRTF corresponding to the first sound source position with a second normalized HRTF corresponding to a position of the first speaker.

* * * * *